US010765148B2

(12) United States Patent
Hawes et al.

(10) Patent No.: US 10,765,148 B2
(45) Date of Patent: Sep. 8, 2020

(54) E-VAPING DEVICE INCLUDING E-VAPING CASE WITH SLIDING MECHANISM FOR INITIATING VAPOR GENERATION

(71) Applicant: Altria Client Services LLC, Richmond, VA (US)

(72) Inventors: Eric Hawes, Midlothian, VA (US); Chris Simpson, Richmond, VA (US); Terrance Theodore Bache, Richmond, VA (US); David Schiff, Highland Park, NJ (US)

(73) Assignee: Altria Client Services LLC, Richmond, VA (US)

( * ) Notice: Subject to any disclaimer, the term of this patent is extended or adjusted under 35 U.S.C. 154(b) by 643 days.

(21) Appl. No.: 15/390,811

(22) Filed: Dec. 27, 2016

(65) Prior Publication Data

US 2018/0177230 A1 Jun. 28, 2018

(51) Int. Cl.
*A24F 47/00* (2020.01)
*A61M 15/06* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS 3,819,282 A 6/1974 Schultz
5,666,977 A * 9/1997 Higgins ..... A24F 47/008 128/200.14
8,794,434 B2 8/2014 Scatterday et al.
9,936,735 B1 * 4/2018 Shotey ..... A24F 47/008
(Continued)

FOREIGN PATENT DOCUMENTS

WO WO-2013012157 A1 1/2013
WO WO-2014086730 A1 5/2014
(Continued)

OTHER PUBLICATIONS

International Search Report and Written Opinion for corresponding PCT Application No. PCT/EP2017/084435 dated Apr. 19, 2018.
(Continued)

*Primary Examiner* — Thor S Campbell
(74) *Attorney, Agent, or Firm* — Harness, Dickey & Pierce, P.L.C.

(57) ABSTRACT

An e-vaping case includes a housing, a guide structure, a cartridge receiving portion connected to the guide structure, and an electronics system in the housing. The cartridge receiving portion is configured to be moved along the guide structure between a first surface and a second surface of the housing. The electronics system includes a power supply that is configured to initiate a transfer of power to an electrical contact structure if the cartridge receiving portion is moved towards the first surface of the housing to at least a first position of the housing. The electronics system is configured to interrupt the transfer of power to the electrical contact structure if the cartridge receiving portion is moved towards the second surface of the housing. An electronic vaping device may include a cartridge detachably coupled to the cartridge receiving portion.

15 Claims, 17 Drawing Sheets

(56) References Cited

U.S. PATENT DOCUMENTS

| | | | | |
|---|---|---|---|---|
| 9,999,245 | B1 * | 6/2018 | Zhu | A24F 47/008 |
| 10,136,677 | B2 * | 11/2018 | Qiu | A24F 47/008 |
| 10,314,341 | B2 * | 6/2019 | Shin | A24F 47/002 |
| 10,357,061 | B2 * | 7/2019 | Li | A61M 15/0023 |
| 2005/0034723 | A1 * | 2/2005 | Bennett | A61K 9/007 128/203.12 |
| 2007/0102013 | A1 * | 5/2007 | Adams | A24F 47/008 131/273 |
| 2008/0038363 | A1 * | 2/2008 | Zaffaroni | A61M 11/041 424/502 |
| 2010/0181387 | A1 * | 7/2010 | Zaffaroni | A61M 15/06 239/13 |
| 2010/0313901 | A1 | 12/2010 | Fernando et al. | |
| 2012/0090630 | A1 * | 4/2012 | Hon | A24F 47/002 131/273 |
| 2013/0167854 | A1 | 7/2013 | Shin | |
| 2014/0053857 | A1 | 2/2014 | Liu | |
| 2014/0060554 | A1 * | 3/2014 | Collett | H05B 3/265 131/328 |
| 2014/0202454 | A1 * | 7/2014 | Buchberger | A24F 47/008 128/200.14 |
| 2014/0224267 | A1 * | 8/2014 | Levitz | A24F 47/008 131/329 |
| 2014/0299492 | A1 | 10/2014 | Liu | |
| 2014/0339213 | A1 | 11/2014 | Bao | |
| 2014/0353185 | A1 | 12/2014 | Liu | |
| 2015/0320116 | A1 * | 11/2015 | Bleloch | A61M 15/06 219/628 |
| 2016/0050975 | A1 | 2/2016 | Worm et al. | |
| 2016/0150828 | A1 * | 6/2016 | Goldstein | A24F 47/008 392/387 |
| 2017/0251719 | A1 * | 9/2017 | Cyphert | A24F 1/00 |
| 2018/0070639 | A1 * | 3/2018 | Chen | A24F 47/008 |
| 2018/0184712 | A1 * | 7/2018 | Fraser | A24F 47/008 |
| 2018/0192700 | A1 * | 7/2018 | Fraser | A24F 47/008 |
| 2019/0124979 | A1 * | 5/2019 | Sebastian | H05B 6/108 |
| 2019/0200677 | A1 * | 7/2019 | Chong | A24F 47/008 |
| 2019/0230987 | A1 * | 8/2019 | Wu | A24F 47/008 |

FOREIGN PATENT DOCUMENTS

| | | | |
|---|---|---|---|
| WO | WO-2015/180072 | A1 | 12/2015 |
| WO | WO-2016/099045 | A1 | 6/2016 |
| WO | WO-2016/109846 | A1 | 7/2016 |

OTHER PUBLICATIONS

Wikipedia—Retractable Pen (last retrieved Dec. 19, 2016) [https://en.wikipedia.org/wiki/Retractable_pem].
Vuse Vapor, https://vusevaper.com (last retrieved Apr. 6, 2016).

* cited by examiner

E-VAPING DEVICE INCLUDING E-VAPING CASE WITH SLIDING MECHANISM FOR INITIATING VAPOR GENERATION

BACKGROUND

Field

The present disclosure generally relates to a case for an electronic vaping device and/or more particularly to an e-vaping case including a sliding mechanism for initiating vapor generation and/or an electronic vaping device including the e-vaping case.

Related Art

An electronic vaping device (also referred to as e-vaping device) may be used to generate a vapor from a pre-vapor formulation. The vapor may be withdrawn from the electronic vaping device by applying a negative pressure to a mouthpiece of the electronic vaping device. The pre-vapor formulation may include a nicotine-containing material, a liquid (e.g., water), and a vapor former. The pre-vapor formulation may further include one or more flavoring additives.

An electronic vaping device may include a power source and a cartridge. The power source may be a battery section. The cartridge may include a reservoir for holding the pre-vapor formulation and a heater for vaporizing the pre-vapor formulation to produce a vapor. The electronic vaping device may include a pressure sensor. The heater may be activated when the pressure sensor detects a negative pressure has been applied to the mouthpiece of the electronic vaping device.

SUMMARY

At least one example embodiment relates to an e-vaping case and/or an electronic vaping device including the e-vaping case.

In an example embodiment, an e-vaping case includes a housing, a guide structure, a cartridge receiving portion connected to the guide structure, and an electronics system in the housing. The guide structure extends between a first surface of the housing and a second surface of housing. The cartridge receiving portion is configured to be moved along the guide structure between the first surface and the second surface of the housing. The electronics system includes a power supply that is configured to initiate a transfer of power to an electrical contact structure if the cartridge receiving portion is moved towards the first surface of the housing to at least a first position of the housing. The electronics system is configured to interrupt the transfer of power to the electrical contact structure if the cartridge receiving portion is moved towards the second surface of the housing.

The guide structure may be a sliding mechanism in the housing. The housing may define a cavity. The electronics system may be in the cavity. The sliding mechanism may include a first plate, tracks, and a second plate in the housing. The tracks may connect the first plate to the second plate. The cartridge receiving portion may be connected to the first plate, and the cartridge receiving portion may be configured to move bi-directionally between the first and second surfaces of the housing via the tracks.

The e-vaping case may further include a button attached to the housing. The button may be electrically connected to the electronics system. The electronics system may be configured to transfer power to the electrical contact structure using the power supply if the cartridge receiving portion is positioned at the first position of the housing and the button is pressed.

The e-vaping case may further include a switch sensor in the housing and a button structure connected to the cartridge receiving portion. The button structure may be configured to contact the switch sensor if the cartridge receiving portion is moved to the first position in the housing. The switch sensor may be configured to depress momentarily if the cartridge receiving portion is moved past the first position to a second position in the housing. The second position in the housing may be closer to the first surface of the housing than the first position in the housing. The switch sensor may be configured to snap back to the first position of the housing after being depressed momentarily.

The electronics system may be configured to initiate the transfer of power to the electrical contact structure if the position of the button structure is adjusted to depress the switch sensor a plurality of times within a threshold period.

The electronics system may be configured to terminate the transfer of power to the electrical contact structure using the power supply if the button is pressed longer than a threshold amount of time.

The e-vaping case may not include a puff sensor.

An electronic vaping device may include the e-vaping case described above and a cartridge on the cartridge receiving portion. The cartridge may be configured to be detachably coupled to the cartridge receiving portion and to be electrically connected to the electrical contact structure, and the electronics system may include the electrical contact structure.

According to an example embodiment, a method of making an e-vaping case includes arranging a guide structure between a first surface of a housing and a second surface of the housing, connecting a cartridge receiving portion to the guide structure, and arranging an electronics system in the housing. The cartridge receiving portion is configured to be moved along the guide structure between the first surface and the second surface of the housing. The electronics system includes a power supply that is configured to initiate a transfer of power to an electrical contact structure if the cartridge receiving portion is moved towards the first surface of the housing to at least a first position of the housing. The electronics system is configured to interrupt the transfer of power to the electrical contact structure if the cartridge receiving portion is moved towards the second surface of the housing.

According to an example embodiment, a sliding mechanism includes a first plate, a guide member, a stopper, and tracks. The first plate defines a first opening and a second opening that are spaced apart from each other. The stopper is attached to the guide member. The tracks engage sides of the first plate to edges of the guide member. The stopper extends through the first opening. The first plate is configured to move bi-directionally via the tracks.

BRIEF DESCRIPTION OF THE DRAWINGS

The above and other features and advantages of example embodiments will become more apparent by describing in detail, example embodiments with reference to the attached drawings. The accompanying drawings are intended to depict example embodiments and should not be interpreted to limit the intended scope of the claims. The accompanying drawings are not to be considered as drawn to scale unless explicitly noted.

DETAILED DESCRIPTION

Figure 1A:
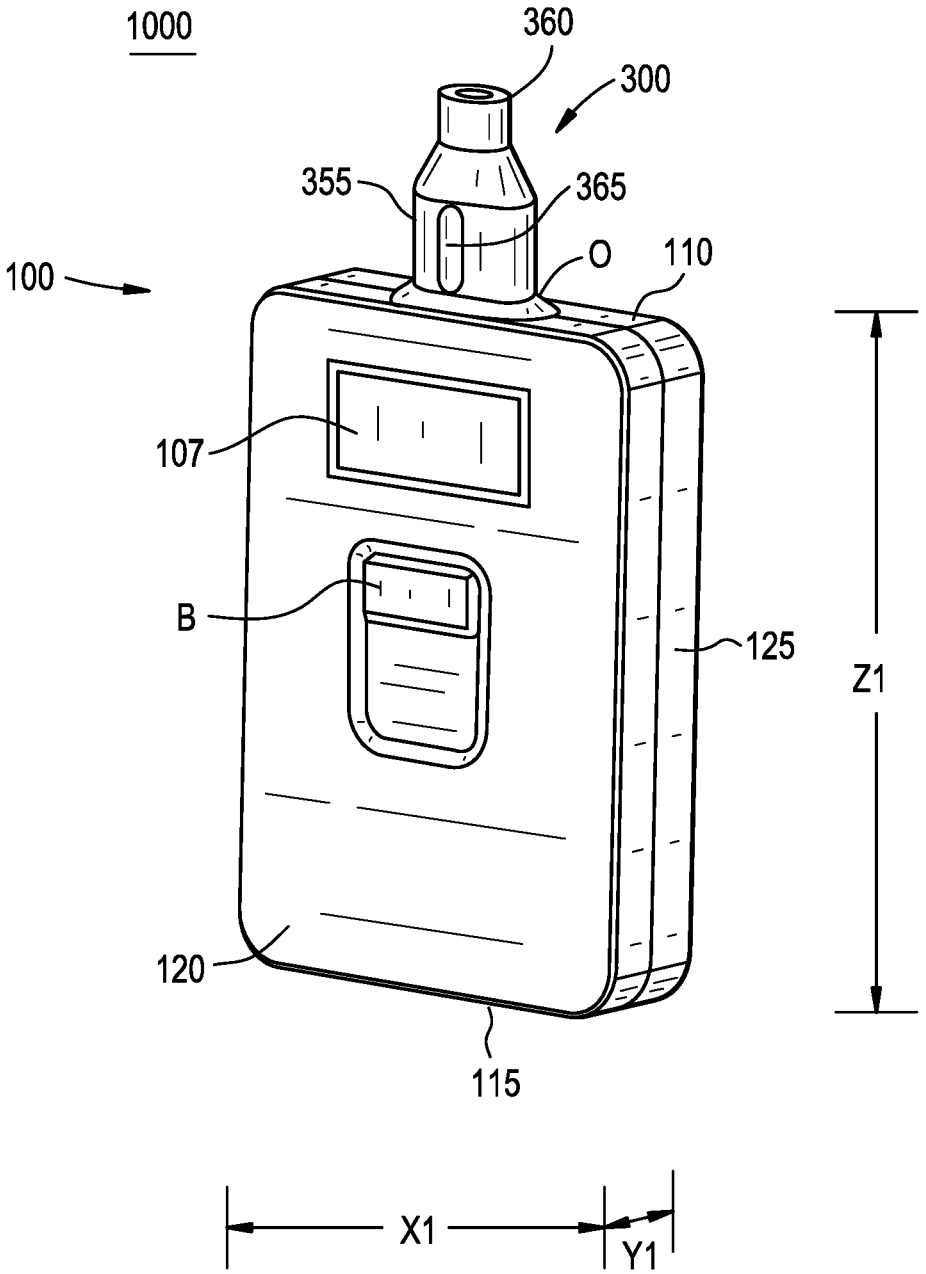
FIG. 1A is a perspective view of an electronic vaping device according to an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of example embodiments.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Throughout the illustrative description, the examples, and the appended claims, a numerical value of a parameter, feature, object, or dimension, may be stated or described in terms of a numerical range format. It is to be fully understood that the stated numerical range format is provided for illustrating implementation of the forms disclosed herein, and is not to be understood or construed as inflexibly limiting the scope of the forms disclosed herein.

Moreover, for stating or describing a numerical range, the phrase "in a range of between about a first numerical value and about a second numerical value," is considered equivalent to, and means the same as, the phrase "in a range of from about a first numerical value to about a second numerical value," and, thus, the two equivalently meaning phrases may be used interchangeably.

When the terms "about" or "substantially" are used in this specification in connection with a numerical value, it is intended that the associated numerical value include a tolerance of ±10% around the stated numerical value unless the context indicates otherwise. Moreover, unless the context indicates otherwise, when reference is made to percentages in this specification, it is intended that those percentages are based on weight, i.e., weight percentages. The expression "up to" includes amounts of zero to the expressed upper limit and all values therebetween. When ranges are specified, the range includes all values therebetween such as increments of 0.1%.

A pre-vapor formulation is a material or combination of materials that may be transformed into a vapor. For example, the pre-vapor formulation may be a liquid, solid and/or gel formulation including, but not limited to, water, beads, solvents, active ingredients, ethanol, and/or vapor formers such as glycerin and/or propylene glycol. For example, a vapor may be generated from the pre-vaporization formulation by heating the vaporization formulation above a threshold temperature (e.g., a boiling point of the pre-vaporization formulation).

A vaporizer, vaporizer assembly, vaporizer arrangement may refer to portion of an electronic vaping device (e.g., a wick and coil heater or an integral body) that is configured to generate vapor through the application of heat to a pre-vapor formulation.

Figure 1B:
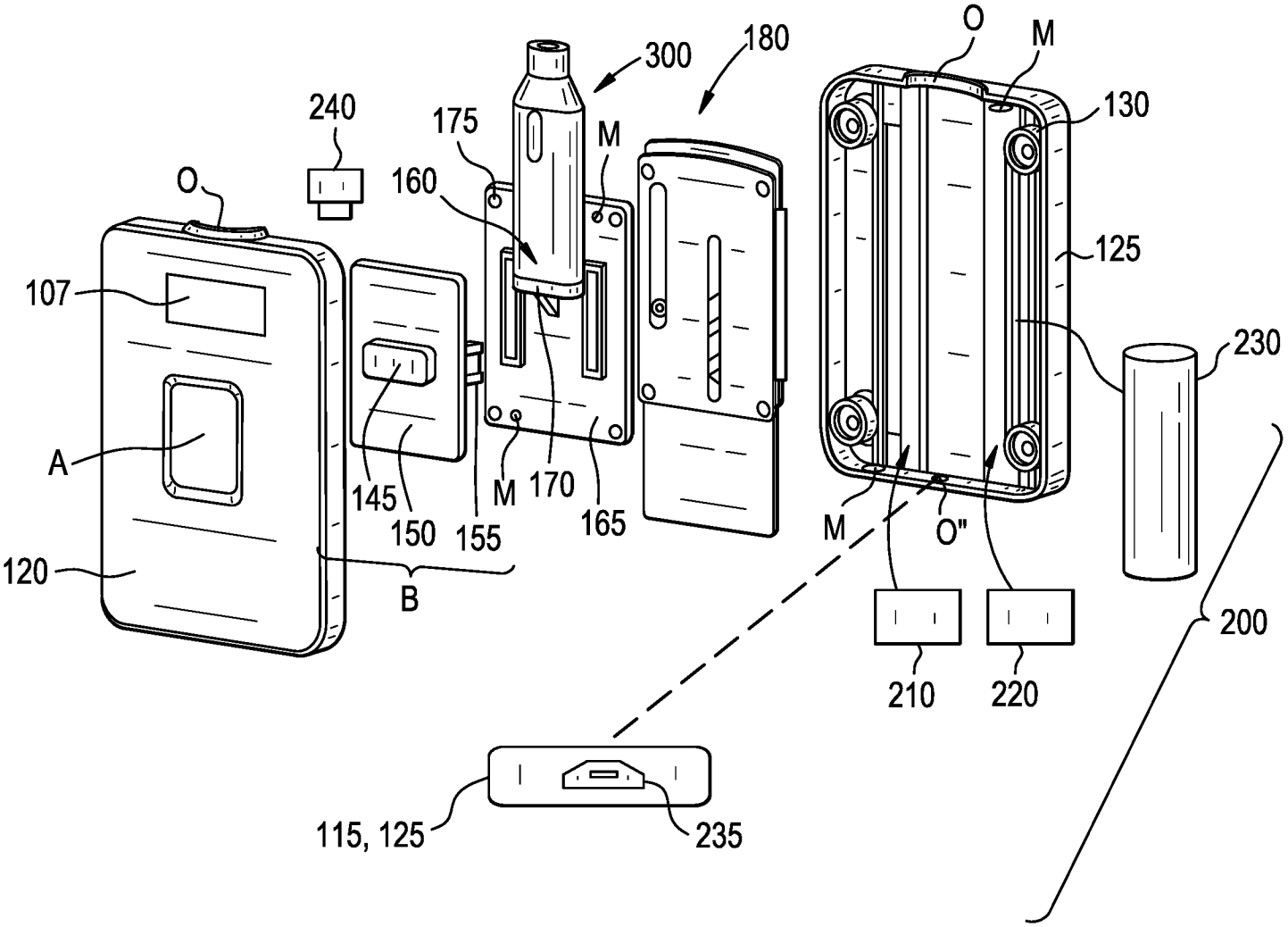
FIG. 1B is an exploded view of the electronic vaping device in FIG. 1A.
Figure 1C:
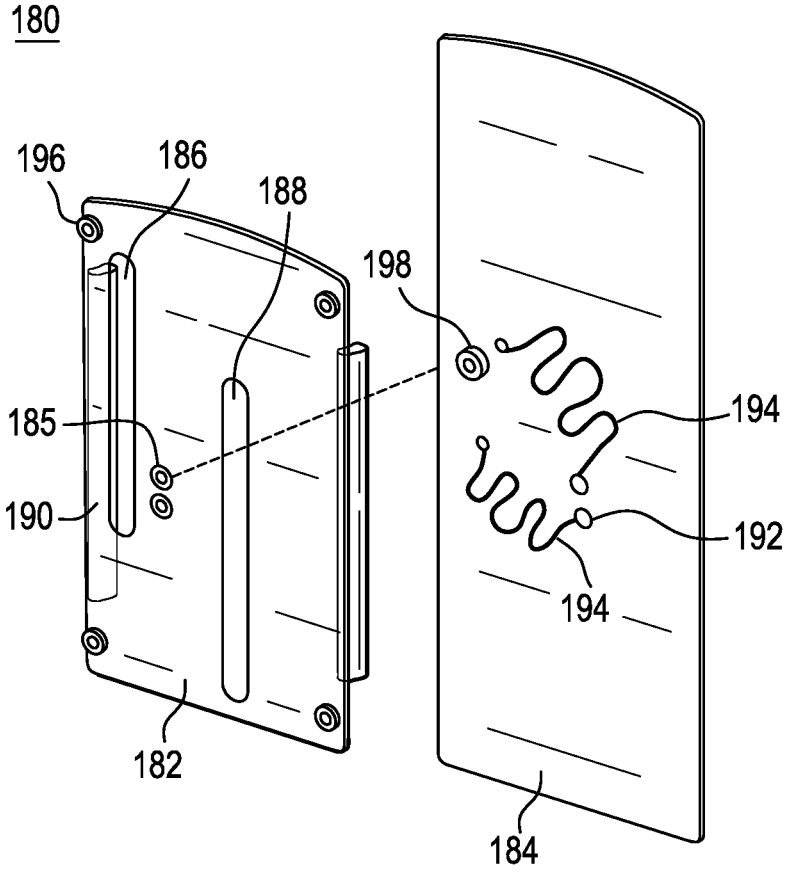
FIG. 1C is perspective view of a sliding mechanism in the electronic vaping device in FIG. 1A.

FIG. 1A is a perspective view of an electronic vaping device according to an example embodiment. FIG. 1B is an exploded view of the electronic vaping device in FIG. 1A. FIG. 1C is perspective view of a sliding mechanism in the electronic vaping device in FIG. 1A.

Referring to FIG. 1A, according to an example embodiment, an electronic vaping device 1000 may include an e-vaping case 100 and a cartridge 300. The e-vaping case 100 may include a housing (e.g., a combined structure including the front cover 120 and the rear cover 125), a guide structure that extends between a first surface 110 (or top surface) of the housing and a second surface 115 (or bottom surface) of the housing, a cartridge receiving portion connected to the guide structure, and an electronics system in the housing. The details of the guide structure are described later with reference to FIGS. 1B and 1C.

The housing may define an opening O at the first surface 110 of the housing. The electronic vaping device 1000 may be formed by inserting the cartridge 300 into the opening O of the e-vaping case 100. The cartridge 300 may include a body portion 355. The body portion 355 may include a window 365 that is transparent and/or translucent. As a result, contents inside the body portion 355 (e.g., a level a pre-vapor formulation inside the cartridge 300) may be viewable through window 365. A button structure B may be exposed through an aperture defined by the front cover 120 of the housing. More details related to the cartridge 300 are described later with reference to FIG. 1H.

The housing (e.g., front cover 120 and rear cover 125) material is not particularly limited. For example, the housing may be formed of a metal, a metal alloy, wood, a ceramic, a plastic, or a composite material containing a combination thereof. For example, the housing may be formed of polypropylene, polyethylene, polyetheretherketone (PEEK), or polyacetate, but is not limited thereto. The e-vaping case 100 may have an ergonomic size so that the e-vaping case 100 may be hand held. The e-vaping case 100 may have a width that is greater than its thickness. The e-vaping case may have a height that is greater than its width. For example, the e-vaping case 100 may have a width X1 in a range from about 1.0 to about 4 inches (e.g., about 2.5 cm to about 10.2 cm), a thickness Y1 in a range from about 0.25 to about 1.00 inches (e.g., about 0.64 cm to about 2.5 cm), and a height Z1 in a range from about 2 to about 6 inches (e.g., about 5.1 cm to about 15.2 cm), but is not limited thereto.

An electronics system (see electronics system 200 in FIG. 1B) inside of the e-vaping case 100 may be connected to a display screen 107 (e.g., a liquid-crystal display or a light emitting device display) for displaying information about the electronic vaping device 1000. The display screen 107 may be attached to an exterior surface of the housing, such as an exterior surface of the front cover 120.

Referring to FIG. 1B, the front cover 120 and the rear cover 125 may be connected to each other to define a housing that encloses the button structure B, a carrier structure 160, a sliding mechanism 180, and an electronics system 200. Although not illustrated, one side of the front cover 120 that faces the rear cover 125 may include male connecting members that correspond to the positions of the female connecting members 130 on the rear cover 125. Thus, the front cover 120 and rear cover 125 may be connected to each other by a snap fit connection when the male connecting members of the front cover 120 are inserted into the female connecting members 130 of the rear cover 125. Additionally, or in the alternative, an adhesive may be used to connect the front cover 120 to the rear cover 125. Even though an example is illustrated where the rear cover 125 includes four female connecting members 130 adjacent to corners of the rear cover 125, example embodiments are not limited to thereto and the number and or respective positions of the female connecting members 130 may vary. Additionally, the positions and number of male connecting members on the front cover 120 may vary according to the number of female connecting members 130. Also, one of ordinary skill in the art would appreciate that alternative connections besides snap-fit connections may be used to secure the front cover 120 to the rear cover 125.

The front cover 120 may define an aperture A and part of the opening O. The aperture A may be spaced apart from the first surface 110, second surface 115, and side surfaces of the front cover 120. The aperture A may be between the first surface 110 and the second surface 115 of the housing. For example, the aperture A may be centrally formed in the front cover 120. The rear cover 125 may define another part of the opening O such that the front cover 120 and rear cover 125 define the opening together.

The button structure B may include a button protruding portion 145, a button wall portion 150, and a button connecting portion 155. The button wall portion 150 may have a rectangular shape but is not limited thereto. The button protruding portion 145 may protrude from one surface (e.g., front surface) of the button wall portion 150. The button connecting portion 155 may connect to another surface (e.g., back surface) of the button wall portion 150. The button structure B, and constituent parts thereof, may be formed of a metal, a metal alloy, wood, a ceramic, a plastic, or a composite material containing a combination thereof. For example, the button structure B may be formed of polypropylene, polyethylene, polyetheretherketone (PEEK), or polyacetate, but is not limited thereto.

The carrier structure 160 may include a carrier plate 165 and a cartridge receiving portion 170 connected to the carrier plate 165. The carrier plate 165 may define holes 175. In FIG. 1B, an example is shown where the carrier plate 165 defines four holes 175, but example embodiments are not limited thereto. The carrier plate 165 may define slots at respective sides of the cartridge receiving portion 170. The button structure B may be connected to the carrier plate 165. For example, the button connecting portion 155 of the button structure B may be inserted into the slots defined by the carrier plate 165. The cartridge receiving portion 170 may be connected to a part of the carrier plate 165 that is between the slots defined by the carrier plate 165. The cartridge 300 may connect to a top surface of the cartridge receiving portion 170 in order to make an electrical connection. For example, the cartridge 300 may connect to a top surface of the cartridge receiving portion 170 and the electrical contact structure 245 like a phone jack, DC jack, or USB plug, etc. Although not shown in FIG. 1B, electrical leads (see 380 in FIG. 1H) may connect the cartridge 300 to the electronics system 200 through the cartridge receiving portion 170. Carrier screws may be inserted through the holes 175 to connect the carrier structure 160 to the securing member 196 of the sliding mechanism 180 (see FIG. 1C).

The carrier structure 160 may be formed of a metal, a metal alloy, wood, a ceramic, a plastic, or a composite material containing a combination thereof. For example, the button structure B may be formed of polypropylene, polyethylene, polyetheretherketone (PEEK), or polyacetate, but is not limited thereto. The carrier screws connecting the carrier plate 165 to the securing member 196 of the sliding mechanism may be formed of a metal or metal alloy. The electrical leads connecting the cartridge 300 to the electronics system 200 may be formed of a metal or metal alloy.

One or more magnets M may be attached to the carrier structure 160. The magnets M attached to the carrier structure 160 may be adjacent to the top and bottom surfaces of the carrier structure 160, on sidewalls of the carrier structure 160, or connected to the top and bottom surfaces of the carrier structure 160. Corresponding magnets M may be attached to an inner surface of the rear cover 125 (and/or front cover 120) adjacent to the top and bottom the rear cover 125 (and/or front cover 120). The magnets M attached to the rear cover 125 (and/or front cover 120) may have a polarity that is opposite a polarity of the magnets M attached to the carrier structure 160. As a result, if the carrier structure 160 is moved near the first surface 110, the magnets M near the top of the carrier structure 160 may be attracted magnetically to the magnets M near the top of the rear cover 125 (and/or front cover 120). Similarly, if the carrier structure 160 is moved near the second surface 115, the magnets M near the bottom of the carrier structure 160 may be attracted magnetically to the magnets M near the bottom of the rear cover 125 (and/or front cover 120). One of ordinary skill in the art would appreciate that the strength of the magnets M may be relatively weak to avoid interfering with the functions of the electronics system 200 and/or to avoid interfering with moving the carrier structure 160 bi-directionally between the first surface 110 and the second surface 115 of the housing. In some example embodiments, the magnets M on the carrier structure 160 and the rear cover 125 (and/or front cover 120) may be omitted.

The electronics system 200 may include a driving circuit 210, a controller 220, a memory (not shown), a power supply 230, an external device connection structure 235, and a switch sensor 240, which may be connected to each other through wires and a bus. The controller 220 may include one or more Central Processing Units (CPUs), digital signal processors (DSPs), one or more circuits, application-specific-integrated-circuits (ASICs), field programmable gate arrays (FPGAs), and/or computers or the like configured as special purpose machines to perform the functions of the controller 220. The memory may be integrated with the controller 220. The memory may be a volatile memory device (e.g., DRAM chip) or a non-volatile memory device (e.g., flash memory). The power supply 230 may be a Lithium-ion battery or one of its variants, for example a Lithium-ion polymer battery. Alternatively, the battery may be a Nickel-metal hydride battery, a Nickel cadmium battery, a Lithium-manganese battery, a Lithium-cobalt battery or a fuel cell. The power supply 230 may be rechargeable (e.g., rechargeable) and include circuitry allowing the battery to be chargeable by an external charging device. The controller 220 may be connected to the display screen 107. In response to commands received from the controller 220, the display screen 107 may display various operational information about the electronic vaping device 1000, such as the battery charge level, vapor precursor level, puff count, and various operation error messages transmitted, but example embodiments are not limited thereto.

The external device connection structure 235 may be connected to an external device (e.g., charger, computer) for charging the power supply 230. The external device connection structure 235 may also be used to transfer data, commands, and/or software between the e-vaping case 100 and the external device. The external device connection structure 235 may be a female USB charging structure (e.g., female micro-USB), but example embodiments are not limited thereto. The external device connection structure 235 may be disposed in an opening O" defined by the bottom of the rear cover 125.

Referring to FIG. 1C, the sliding mechanism 180 may include a first plate 182 and a second plate 184. The second plate 184 may also be referred to as a guide member. A height of the second plate 184 may be slightly less than a height of the rear cover 125. For example, when the second plate 184 is placed inside the housing (e.g., front cover 120 and rear cover 125 connected to each other), the upper surface of the second plate 184 may be in contact with (or near) an internal surface of the rear cover 125 opposite the first surface 110 and the lower surface of the second plate 184 may be in contact with (or near) an internal surface of the rear cover 125 opposite the second surface 115. Tracks 190 (e.g., rails structures) may be connected to sides of the first plate 182. The tracks 190 may engage sides of the first plate 182 to edges of the second plate 184. The tracks 190 may be formed of a metal or a metal alloy, but are not limited thereto. The first plate 182 and the second plate 184 may be formed of any of the materials described above for forming the front cover 120 and rear cover 125.

The first plate 182 may define a first opening 186 and a second opening 188 that are spaced apart from each other in a staggered manner (e.g., spaced apart diagonally from each other). The first and second openings 186 and 188 may be at different heights in the first plate 182. The first opening 186 may be adjacent to one of the sides of the first plate 182.

Securing members 196 may be connected to the first plate 182. The securing members 196 may correspond to the positions of the holes 175 in the carrier plate 165 (see FIG. 1B). For example, the securing members 196 may be attached to corner regions of the first plate 182. Thus, securing members 196 may define threaded holes or recesses. Thus, carrier screws may be inserted through the holes 175 of the carrier plate 165 in order to connect the carrier structure 160 to the first plate 182.

The guide structure may include first connection members 185 (e.g., rivets), springs 194, second connection members 192, and one or more stoppers 198. The first connection members 185 may be attached to the first plate 182. The first connection members 185 may be attached to an area of the first plate between a bottom region of the first opening 186 and a middle region of the second opening 188. The second connection members 192 may be attached to the second plate 184. The first connection members 185 may be spaced apart from each other and may connect a first end of the springs 194 to the first plate 182. Each first end of the springs 194 may be connected to a corresponding one of the first connection member 185. The springs 194 may extend from the first connection members 185 through the second opening 188 to the second plate 184. The second connection members 192 may connect a second end of the springs 194 to the second plate 184. Each second end of the springs 194 may be connected to a corresponding one of the second connection members 192. The stopper 198 may be attached to the second plate 184 and may extend from the second plate 184 into the first opening 186 of the first plate 182. The second opening 188 may be spaced apart in a staggered manner from the first opening 186 such that a top region of the first opening 186 may be closer to a top of the first plate 182 compared to a top region of the second opening 188. The bottom region of the second opening 186 may be closer to a bottom of the first plate compared to the bottom region of the first opening.

The first and second openings 186 and 188 may be elongated parallel to the sides of the first plate 182. A height of the second plate 184 may be greater than a height of the first plate 182. A width of the first plate 182 may be equal to a width of the second plate 184. The first plate 182 may be configured to move bi-directionally in a direction parallel to the sides of the first plate 182. The stopper may be configured to limit a distance the first plate 182 moves bi-directionally by contacting the first plate 182 at a top region of the first opening 186 or a bottom region of the first opening 186.

As shown in FIGS. 1B and 1C, the tracks 190 may fit around the sidewalls of the second plate 184 in order to engage and/or connect the first plate 182 to the second plate 184. The springs 194 may be configured to undergo a compression if the cartridge receiving portion 170 is moved toward the first surface 110 or the second surface 115 of the housing. In an example embodiment, the springs 194 are configured to undergo a compression if the cartridge receiving portion 170 is moved toward a middle of the housing (see FIG. 1E).

Referring to FIGS. 1A to 1C, the guide structure in the e-vaping case 100 of the electronic vaping device 1000 may be defined by the first plate 182, tracks 190, and second plate 184. When the front cover 120 and rear cover 125 enclose the sliding mechanism 180, the guide structure may extend between the first surface 110 and the second surface 115 of the housing (e.g., front cover 120 connected to rear cover 125). The cartridge receiving portion 170 of the carrier structure 160 may be connected to the first plate 182 of the guide structure using carrier screws through the holes 175 to connect the carrier plate 165 to the securing members 196 on the first plate 182. The cartridge receiving portion 170 may be configured to be moved along the guide structure (e.g., first plate 182, tracks 190, and second plate 184) between the first surface 110 and the second surface 115 of the housing (e.g., front cover 120 connected to the rear cover 125).

The cartridge receiving portion 170 may be configured to move bi-directionally between the first and second surfaces 110 and 115 of the housing via the tracks 190. For example, if the button structure B is connected to the carrier structure 160 and the carrier structure 160 is connected to the sliding mechanism 180, and the housing (e.g., front cover 120 and rear cover 125) encloses the button structure B, carrier structure 160, and sliding mechanism 180, the protruding portion 145 of the button structure B may be manually adjusted through the aperture A of the front cover 120.

Figure 1D:
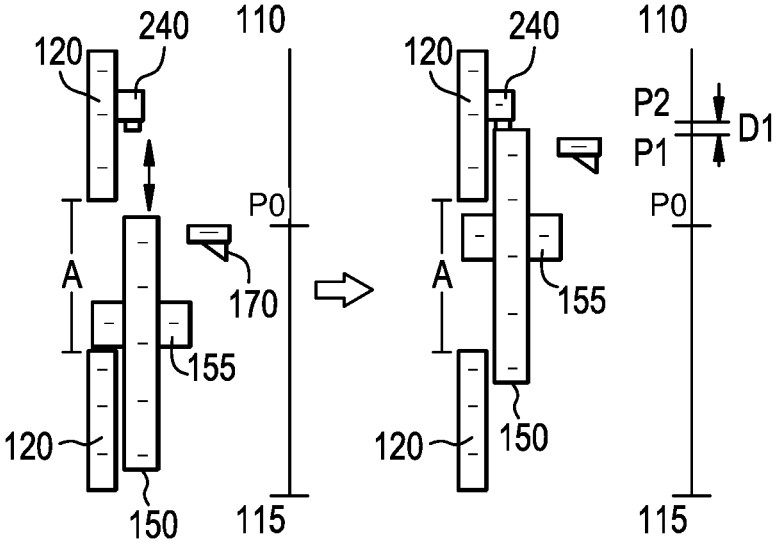
FIG. 1D is a side view illustrating a method of operating the electronic vaping device in FIG. 1A.

FIG. 1D is a side view illustrating a method of operating the electronic vaping device in FIG. 1A.

Referring to FIGS. 1A to 1D, the switch sensor 240 may be positioned in the housing (e.g., front cover 120 connected to rear cover 125) over the button wall portion 150 of the button structure B. The button structure B may be positioned in the housing so the button protruding portion 145 extends into the aperture A and faces an outside of the housing. The button connecting portion 155 may connect the button structure B to the carrier structure 160.

The cartridge receiving portion 170 may be configured to be moved between the first and second surfaces 110 and 115 of the housing by adjusting a position of the button protruding portion 145 in the aperture A such that moving the button protruding portion 145 towards the first surface 110 of the housing corresponds to moving the cartridge receiving portion 170 towards the first surface 110 of the housing and moving the button protruding portion towards the second surface 115 of the housing corresponds to moving the cartridge receiving portion 170 towards the second surface of the housing. As shown in FIG. 1D, when the button protruding portion 145 is near a bottom of the aperture A, the cartridge receiving portion 170 may be at a zero position P0 in the housing.

The aperture A may include a first border (e.g., top border) adjacent to the first surface 110 of the housing and a second border (e.g., bottom border) adjacent to the second surface 115 of the housing. The aperture A may include third and fourth borders (e.g., left and right borders) that connect the first and second borders to each other. The cartridge receiving portion 170 may be configured to be moved between the first and second surfaces 110 and 115 of the housing by adjusting a position of the button protruding portion 145 in the aperture A such that moving the button protruding portion 145 towards the first surface 110 of the housing corresponds to moving the cartridge receiving portion 170 towards the first surface 110 of the housing and moving the button protruding portion 145 towards the second surface 115 of the housing corresponds to moving the cartridge receiving portion 170 towards the second surface 115 of the housing. The first and second borders of the aperture A may limit a distance that the button protruding portion 145 may be adjusted in the aperture A.

The power supply 230 of the electronics system 200 may be configured to initiate a transfer of power to an electrical contact structure (see e.g., the electrical contact structure 245 in the FIG. 1G) if the cartridge receiving portion 170 is moved towards the first surface 110 of the housing to at least a first position P1 of the housing. The first position P1 of the housing may be a first height that is vertically between the first surface 110 and the second surface 115 of the housing. The electronics system 200 may be configured to interrupt the transfer of power to the electrical contact structure if the cartridge receiving portion 170 is moved towards the second surface 115 of the housing.

As shown in FIG. 1D, the button structure, for example the button wall portion 150 of the button structure B (see FIG. 1B), may be configured to contact the switch sensor 240 if the cartridge receiving portion 170 is moved to the first position P1 in the housing. For example, manually pushing the button protruding portion 145 towards a top of the aperture A may move the button wall portion 150 and the cartridge receiving portion 170 towards the first surface 110 because the button protruding portion 145 may be connected to the cartridge receiving portion 170 through the button wall portion 150, button connecting portion 155, and the carrier plate 165. The switch sensor 240 may be configured to depress momentarily if the cartridge receiving portion 170 is moved past the first position P1 to a second position P2 in the housing. The second position P2 in the housing may be closer to the first surface 110 of the housing than the first position P1 in the housing. A travel distance D1 between the first position P1 and the second position P2 may be in a range of about 1/16 of an inch to about 1/4 of an inch (e.g., about 1.6 mm to about 6.4 mm), but is not limited thereto. The switch sensor 240 may be configured to snap back after being depressed momentarily. When the switch sensor 240 snaps back, the button wall portion 150 may be moved towards the second surface 115 of the housing. When the button wall portion 150 moves towards the second surface 115, the button protruding portion 145 and cartridge receiving portion 170 may also be moved towards the second surface 115 of the housing because the button protruding portion 145 and cartridge receiving portion 170 may be connected to the button wall portion 150. Although FIG. 1D illustrates an example where the button wall portion 150 may contact the switch sensor 240. Alternatively, the switch sensor 240 may be positioned so that parts of the carrier structure 160 (e.g., the carrier plate 165) or other structures may contact the switch sensor 240 if the cartridge receiving portion 170 is moved to the first position P1 in the housing.

The switch sensor 240 may be embodied in many different ways. For example, the switch sensor 240 may include a spring so the switch sensor 240 may be configured to be depressed and to snap back after being depressed momentarily. Also, the switch sensor 240 may include a circuit for sensing when the switch sensor 240 is depressed and/or not depressed. However, example embodiments are not limited thereto.

In an example embodiment, the electronics system 200 may be configured to initiate the transfer of power to the electrical contact structure (see e.g., the electrical contact structure 245 in FIG. 1H) if the position of the button structure B is adjusted to depress the switch sensor 240 a plurality of times within a threshold period (e.g., 3 or more times within a 5 second period).

In an example embodiment, the electronics system 200 may be configured to automatically transfer power from the power supply 230 to the electrical contact structure 245 if the cartridge receiving portion 170 is positioned at the first position P1. The e-vaping case may be formed without a puff sensor.

Figure 1E:
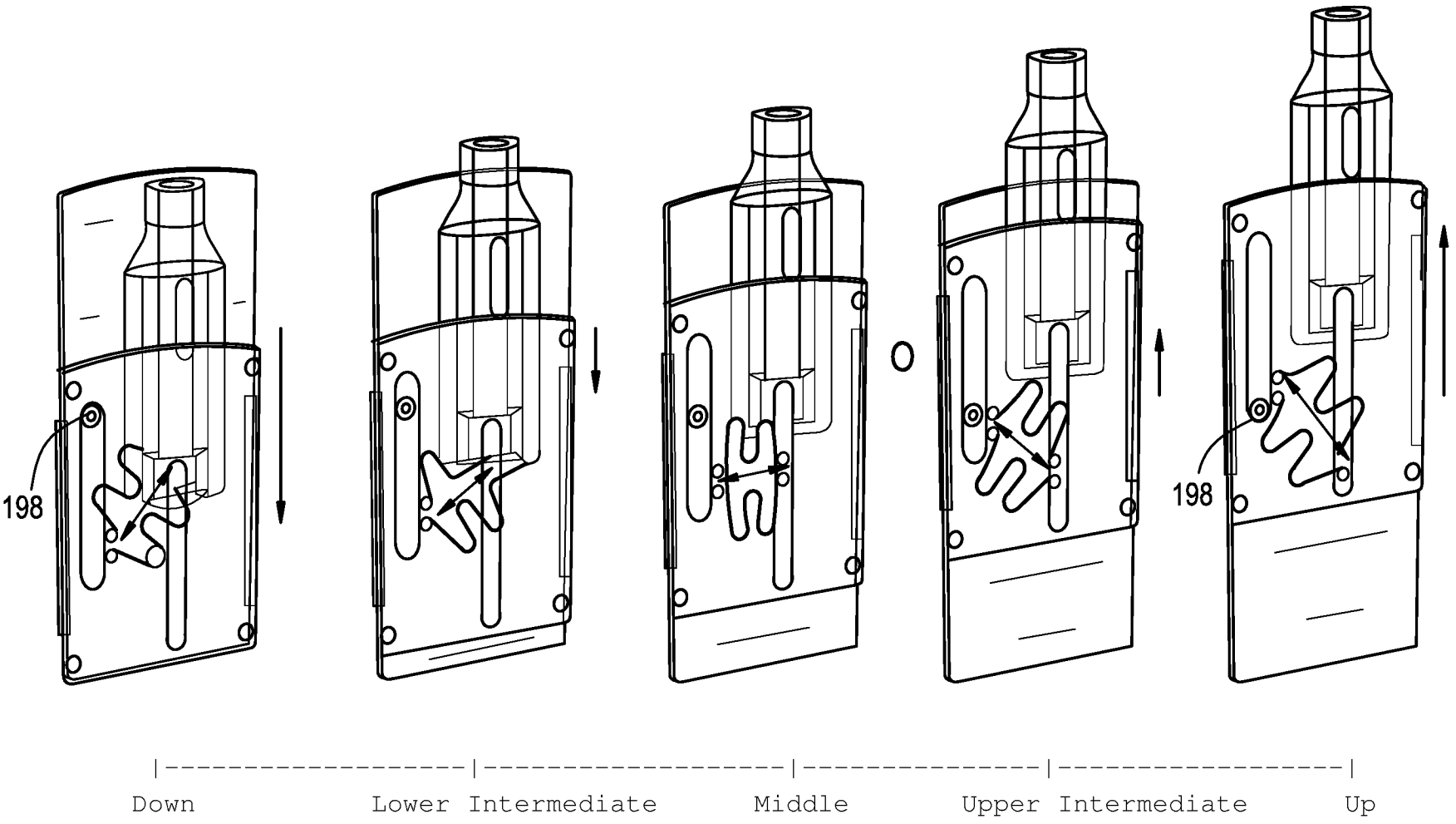
FIG. 1E illustrates perspective views of adjusting the sliding mechanism in the electronic vaping device in FIG. 1A.

FIG. 1E illustrates perspective views of adjusting the sliding mechanism in the electronic vaping device in FIG. 1A.

Referring to FIGS. 1C to 1E, as the position of the cartridge receiving portion 170 is adjusted from a Down position to an Up position, the light arrow indicates the force applied by the springs 194 and the dark arrow or O next to the right of the sliding mechanism 180 indicates the resultant force on the carrier structure 160. As shown by the arrows next to the springs 194 in FIG. 1E, the springs 194 exert forces in two directions. Because the stopper 198 may be positioned in the first opening 186, the stopper 198 may limit how far the cartridge receiving portion 170 may be moved bi-directionally between the Up and Down positions.

The springs 194 may be configured to form a bistable device so that the springs may be loaded in both the Up and Down positions. In other words, the springs 194 may be configured to provide a resistive force that resists moving the cartridge receiving portion 170 towards the Middle position. For example, as shown in FIG. 1E, when the cartridge receiving portion is at the Middle position, the springs 194 may mainly exert a horizontal force. At the Lower Intermediate and Upper Intermediate positions, the forces exerted by the springs 194 may have vertical components. The springs 194 may be configured so a threshold force or greater must be applied to the cartridge receiving portion 170 using the button structure in order to move the cartridge receiving portion 170 toward and past the Middle position from either the Up or Down positions. Otherwise, the cartridge receiving portion 170 will revert back to the original Up or Down position if less than the threshold force is applied to the cartridge receiving portion 170. Thus, the position of the cartridge receiving portion 170 is biased towards the Up or Down positions.

In further detail, referring to FIGS. 1D and 1E, if the cartridge receiving portion 170 is at or near the Down position, or at or near the Up position, then the springs 194 may be configured to provide a resistive force that resists moving the cartridge receiving portion 170 towards the Middle position. The springs 194 may be configured so a threshold force or greater must be applied to the cartridge receiving portion 170 using the button structure in order to move the cartridge receiving portion 170 from the Down position through the Lower Intermediate position and past the Middle position. Otherwise, the cartridge receiving portion 170 will revert back to the Down position if less than the threshold force is applied to the cartridge receiving portion 170. Similarly, the springs 194 may be configured so a threshold force or greater must be applied to the cartridge receiving portion 170 using the button structure in order to move the cartridge receiving portion 170 from the Up position through the Upper Intermediate position and past the Middle position. From the Middle position, the springs 194 will undergo a decompression when the cartridge receiving portion 170 is moved towards the Up or Down positions. Thus, the Middle position serves as a tipping point from which the cartridge receiving portion 170 is urged towards the Up or Down positions.

Figure 1F:
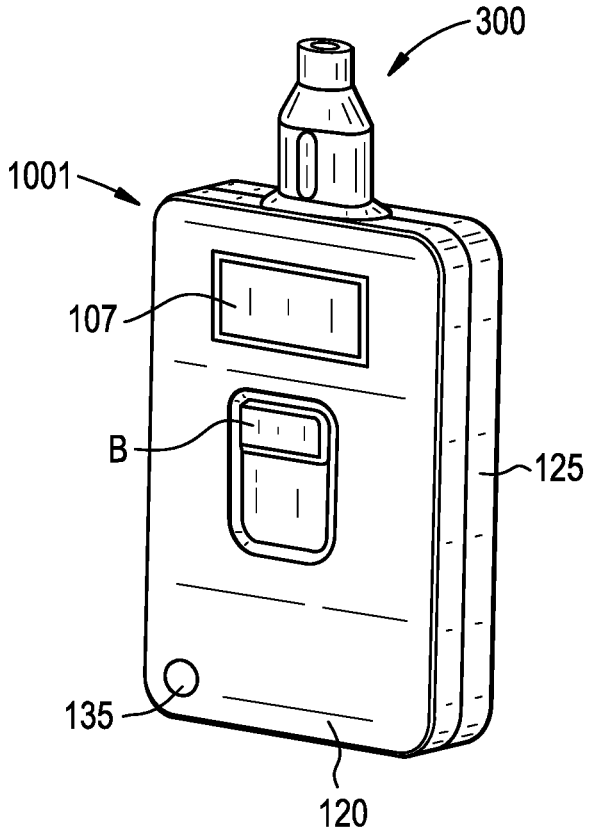
FIG. 1F is a perspective view of an electronic vaping device according to an example embodiment.

FIG. 1F is a perspective view of an electronic vaping device according to an example embodiment.

Referring to FIG. 1F, the electronic vaping device 1001 in FIG. 1F may be the same as the electronic vaping device 1000 described in FIGS. 1A to 1D, except the e-vaping case of the electronic vaping device in FIG. 1F may further include an activation button 135. The activation button 135 may be attached to the housing. For example, the activation button 135 may be arranged on an outer surface of the front cover 120. The activation button 135 may be electrically connected to the electronics system 200. The electronics system 200 may be configured to transfer power to the electrical contact structure 245 using the power supply 230 if the cartridge receiving portion 170 is moved to at least a first position P1 of the housing and the activation button 135 is pressed at the same time.

The electronics system 200 may be configured to interrupt the transfer of power to the electrical contact structure if activation button 135 is released and/or the cartridge receiving portion 170 is moved towards the second surface 115 of the housing. The electronics system 200 may be configured to terminate the transfer of power to the electrical contact structure 245 using the power supply 230 if the activation button 135 is pressed longer than a threshold amount of time (e.g., more than 10 seconds). For example, the controller 220 may be configured to track how long the activation button 135 is pressed down and the controller 220 may prevent the power supply 230 from supplying power to the electrical contact structure 245 if activation button 135 is pressed down for longer than the threshold amount of time without being released.

Figure 1G:
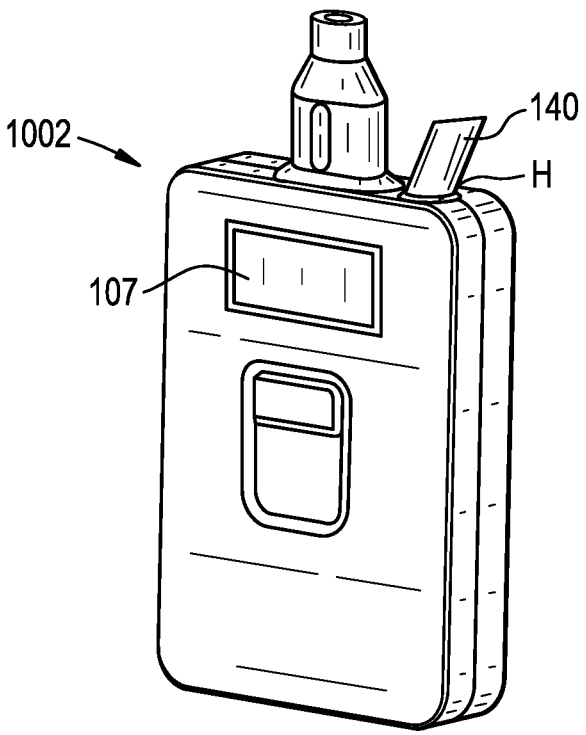
FIG. 1G is a perspective view of an electronic vaping device according to an example embodiment.

FIG. 1G is a perspective view of an electronic vaping device according to an example embodiment.

Referring to FIG. 1G, the electronic vaping device 1002 in FIG. 1G may be the same as the electronic vaping device 1000 described in FIGS. 1A to 1F, except the e-vaping case of the electronic vaping device in FIG. 1G may further include a lid 140 attached to the first surface 110 of the front cover 120 and/or rear cover 125 of the housing. The lid 140 may be secured to the housing by a hinge H. The hinge H may be connected to the first surface 110 of the housing. The hinge H may be formed of a metal or a metal alloy. The lid 140 may be formed of the same material as the front cover 120 and/or rear cover 125. When the cartridge 300 protrudes through the opening O, the lid 140 may be opened. The cartridge 300 may be recessed into the e-vaping case 100 and may be surrounded by the e-vaping case 100 if the cartridge receiving portion 170 is moved along the guide structure towards (e.g., the first plate 182, tracks 190, and second plate 184) the second surface 115 of the e-vaping case 100. The lid 140 may be configured to cover the opening O, cartridge receiving portion 170, and the cartridge 300 if the cartridge receiving portion 170 is recessed into the housing towards the second surface 115 of the housing. For example, when the cartridge 300 is lowered into the housing, the lid 140 may cover the opening O. Also, the lid 140 may cover the opening O even if the cartridge 300 is not inserted in the e-vaping case 100.

Figure 1H:
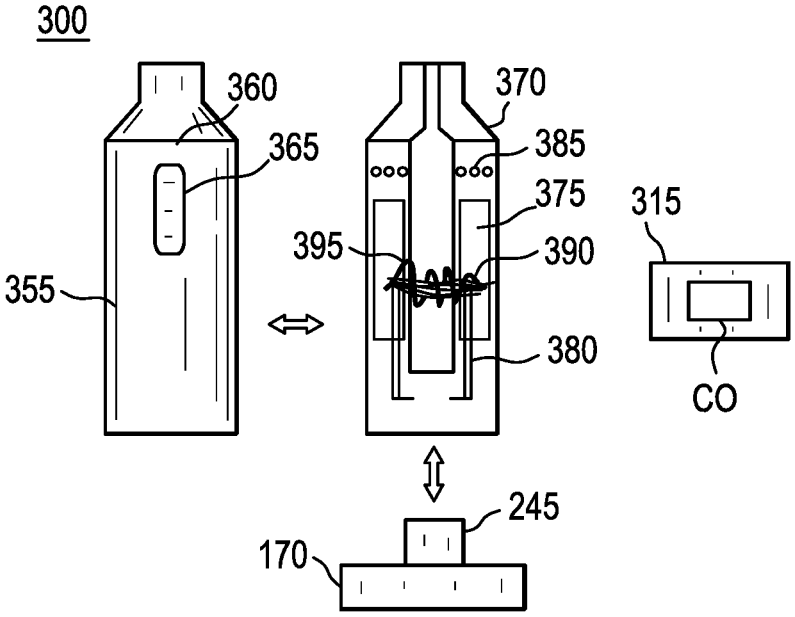
FIG. 1H is a sectional view of a cartridge in the electronic vaping device in FIGS. 1A, 1F, and/or 1G.

FIG. 1H is a sectional view of a cartridge in the electronic vaping device in FIGS. 1A, 1F, and/or 1G.

In an example embodiment, the cartridge 300 may include a mouth portion 360, a body 355 that defines one or more air holes 385, a reservoir 375 in the body for holding a pre-vaporization formulation, a vaporizer configured to generate a vapor from the pre-vaporization formulation, and electrical leads 380 connected to the vaporizer in the body 355. The cartridge 300 may be configured to protrude at least partially out of the e-vaping case if the cartridge receiving portion 170 is moved towards the first surface 110 of the housing, for example to the first position P1. The air hole(s) 385 defined by the body of the cartridge 300 may be exposed if the cartridge 300 is on the cartridge receiving portion 170 and the cartridge receiving portion 170 is moved to the first position P1. A puff sensor may be omitted from the cartridge 300.

A channel 370 may be defined by an inner housing (e.g., a tube or tubular structure) and may be inside the body 355. The channel 370 may be adjacent to the reservoir 375. A top of the channel 370 may extend through the mouth portion 360. The channel 370 may be in fluid communication with the air hole(s) 385 and extend from the body 355 through the mouth portion 360 to an end of the cartridge 300.

The cartridge 300 may be configured to be recessed into the e-vaping case and to be surrounded by the e-vaping case if the cartridge receiving portion 170 is moved along the guide structure towards the second surface 115 of the e-vaping case. In the example shown in FIG. 1G, the lid 140 may be configured to cover the opening O and the cartridge 300 if the cartridge receiving portion 170 is recessed into the housing towards the second surface 115 of the housing. The body 355 and the mouth portion 360 may be each formed of a plastic material, wood, and/or paper, but is not limited to these materials. The body 355 and the mouth portion 360 may be formed of the same material, different materials, or some common materials and some different materials.

The pre-vapor formulation may include nicotine, water, and a vapor former (e.g., glycerin and/or propylene glycol), but is not limited thereto. For example, the pre-vapor formulation may further include an acid and/or flavoring additive. The flavoring additive may include one of menthol, limonene, benzaldehyde, ethyl vanoline, and combinations thereof.

The acid may be one of pyruvic acid, formic acid, oxalic acid, glycolic acid, acetic acid, isovaleric acid, valeric acid, propionic acid, octanoic acid, lactic acid, levulinic acid, sorbic acid, malic acid, tartaric acid, succinic acid, citric acid, benzoic acid, oleic acid, aconitic acid, butyric acid, cinnamic acid, decanoic acid, 3,7-dimethyl-6-octenoic acid, 1-glutamic acid, heptanoic acid, hexanoic acid, 3-hexenoic acid, trans-2-hexenoic acid, isobutyric acid, lauric acid, 2-methylbutyric acid, 2-methylvaleric acid, myristic acid, nonanoic acid, palmitic acid, 4-pentenoic acid, phenylacetic acid, 3-phenylpropionic acid, hydrochloric acid, phosphoric acid, sulfuric acid, and combinations thereof. The acid also may be incorporated in the pre-vapor formulation in the form of a salt.

The vaporizer may include a wick 390 and a heater 395. The heater 395 may surround the wick 390 in the channel 370. For example, the heater 395 may wrap around the wick 390. Respective ends of the heater 395 may be connected to the electrical leads 380. The wick 390 may extend from the reservoir 375 to the channel 370. For example, the wick 390 may extend from one portion of the reservoir 375 through the channel 370 into another portion of the reservoir 375.

The heater 395 may be in the form of a wire coil, a planar body, a ceramic body, a single wire, a cage of resistive wire or any other suitable form. The heater 395 may be wrapped around a part of the wick 390 such as a part of the wick 390 in the channel 370. If the heater 395 generates a vapor from a first portion of the pre-vapor formulation, the wick 390 (or a plurality of wicks) may transport a second portion of the pre-vapor formulation proximate to the heater 395 to replenish the first portion of the pre-vapor formulation formed into the vapor. The vapor may be transported to a top of the mouth portion 360 if a negative pressure is applied to the mouth portion 360.

The wick 390 may be constructed of a fibrous and flexible material. The wick 390 may include at least one filament that is configured to transport pre-vapor formulation from the reservoir 375 to the heater 395 when negative pressure is applied to the mouth portion 360.

The vaporizer may be configured to generate a vapor from heating a portion of the pre-vapor formulation. Power may be supplied to the heater 395 from the power supply 230 (see FIG. 1B) using the electrical contact structure 245 and the electrical leads 380. The power supplied to the heater 395 may generate a vapor from heating the portion of pre-vapor formulation transported to the heater 395 using the wick 390.

Referring to FIG. 1H, the cartridge 300 may include a body 355 and a mouth portion 360. A first surface (e.g., front surface) of the cartridge 300 may include a window 365. The body 355 may include air holes 385. The body 355 may have a curved outer periphery (e.g., oval or circular) and the body 355 may be elongated. In the example shown in FIG. 1H, the air holes 385 are defined on a second surface (e.g., back surface) of the body 355 that is opposite the surface of the body including the window 365, but example embodiments are not limited thereto.

The cartridge receiving portion 170 may include an electrical contact structure 245 for connecting the electrical leads 380 in the cartridge 300 to the electronics system 200 in the e-vaping case. The electrical leads 380 may be formed of a conductive material such as a metal or a metal alloy.

The cartridge 300 may be configured to be detachably coupled to the cartridge receiving portion 170. For example, the cartridge 300 may connect to a surface of the cartridge receiving portion 170 and the electrical contact structure 245 like a phone jack, DC jack, or USB plug, etc. For example, a bottom surface 315 of the cartridge may define a cartridge opening CO and the cartridge 300 may be placed on the cartridge receiving portion 170 so the electrical contact structure 245 extends into the cartridge opening CO and connects to the electrical leads 380. Alternatively, although not illustrated, if the electrical contact structure 245 is alternatively a female electrical connector, then a bottom of the cartridge 300 may include a male electrical connector that may be electrically connected to the electrical leads 380 and may be coupled to the electrical contact structure 245. The electronics system 200 (see FIG. 1B) may be configured to generate vapor from the pre-vaporization formulation by transferring power to the vaporizer of the cartridge through the electrical contact structure 245 and electrical leads 380 if the cartridge receiving portion 170 is moved towards the first surface 110 of the housing to at least the first position P1 of the housing (see FIGS. 1B and 1D).

The electrical leads 380 may be configured to electrically connect the vaporizer to the electrical contact structure 245 of the e-vaping case. The e-vaping case being configured to initiate the generating the vapor by transferring power to the vaporizer of the cartridge using the electrical leads 380. For example, the e-vaping case 100 may be configured to initiate generating the vapor from the pre-vaporization formulation if the cartridge 300 is moved to a first location relative to the e-vaping case. The e-vaping case 100 may be configured to interrupt the generating the vapor if the cartridge 300 is moved toward a second location relative to an end of the e-vaping case. The first location of the cartridge 300 relative to an end of the e-vaping case and the second location of the cartridge 300 relative to an end of the e-vaping case may be different.

Because the electronics system 200 may be configured to initiate a transfer of power to the electrical contact structure 245 if the cartridge 300 is coupled to the cartridge receiving portion 170 and moved towards the first surface 110 of the housing to at least a first position of the housing, the first location of the cartridge 300 relative to the e-vaping case may correspond a location of the cartridge 300 when the cartridge 300 is coupled to the cartridge receiving portion 170 and the cartridge receiving portion 170 is moved to the first surface 110 of the housing to at least a first position of the housing. Because the electronics system 200 may be configured to interrupt the transfer of power to the electrical contact structure 245 if the cartridge receiving portion 170 is moved toward the second surface 115 of the housing to a second position of the housing, the second location of the cartridge 300 relative to the e-vaping case may correspond to a location of the cartridge 300 when the cartridge 300 is coupled to the cartridge receiving portion 170 and the cartridge receiving portion 170 is moved to the second surface 115 of the housing.

Figure 2A:
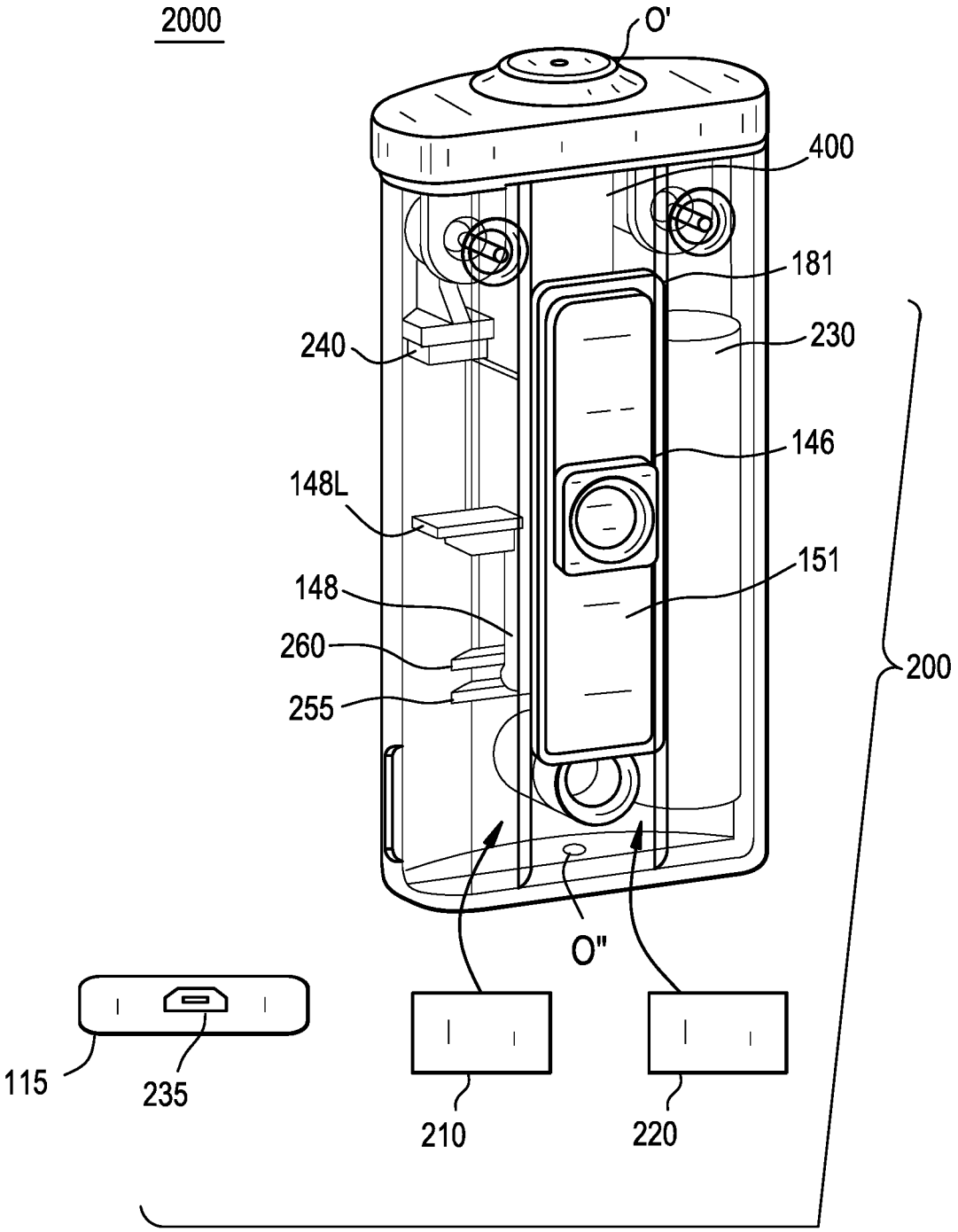
FIGS. 2A and 2B are transparent views of an electronic vaping device according to an example embodiment.
Figure 2B:
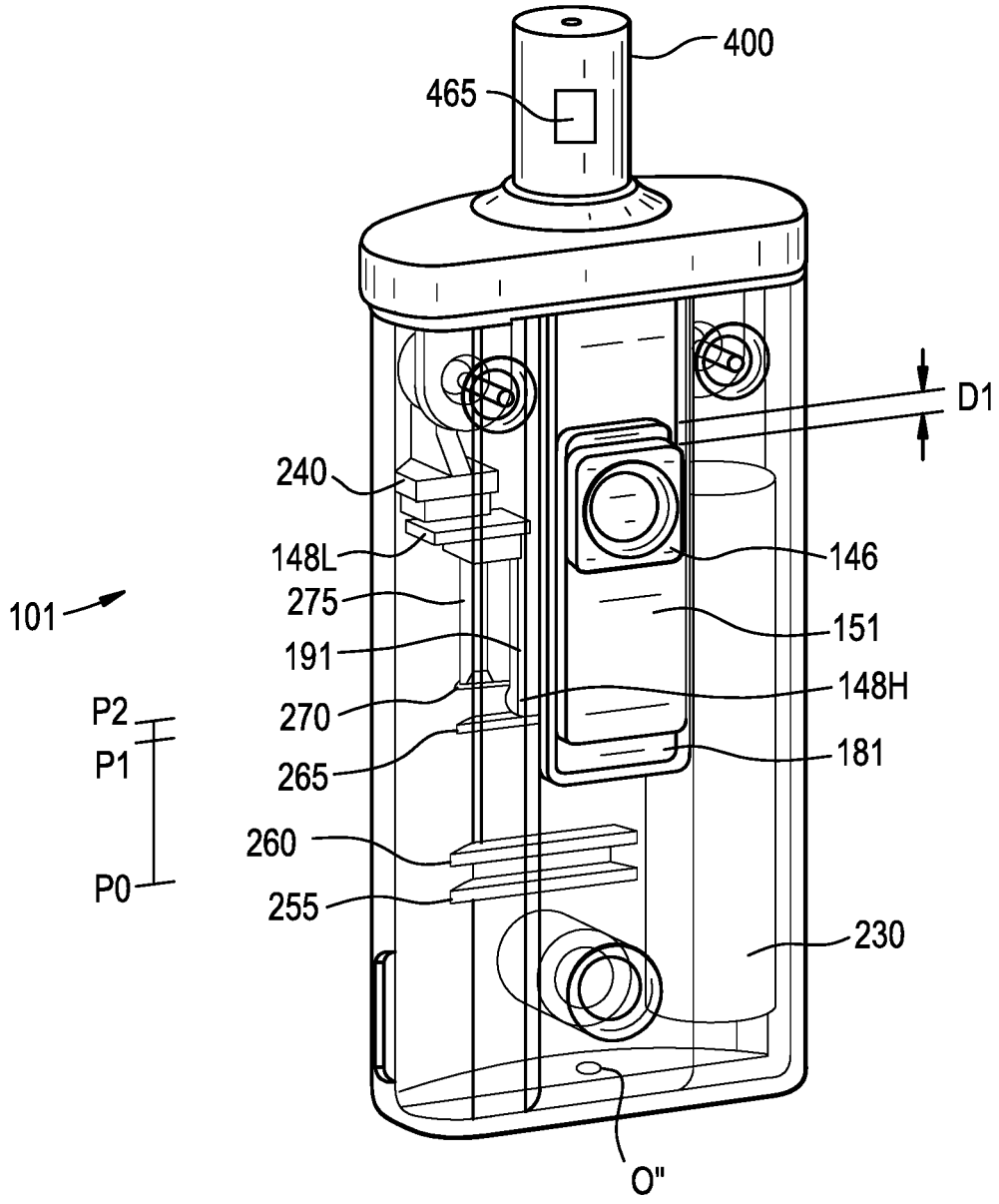
Figure 2C:
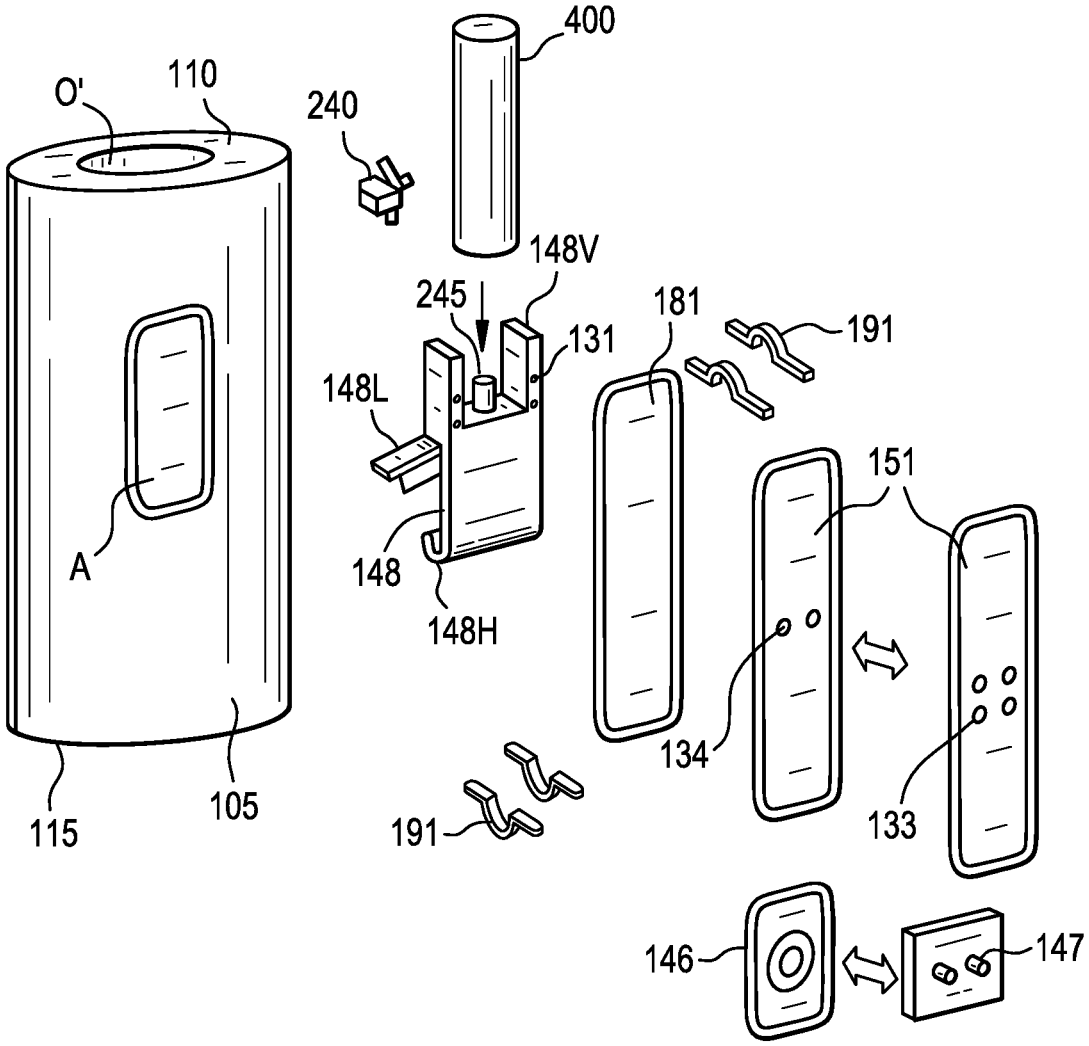
FIG. 2C is an exploded view of the electronic vaping device in FIGS. 2A and 2B.

FIGS. 2A and 2B are transparent views of an electronic vaping device according to an example embodiment. FIG. 2C is an exploded view of the electronic vaping device in FIGS. 2A and 2B.

Referring to FIGS. 2A to 2C, in an example embodiment, an electronic vaping device 2000 may include an e-vaping case 101 and a cartridge 400. The e-vaping case 101 may include a housing, a guide structure 181 that extends between a first surface 110 (or top surface) of the housing and a second surface 115 (or bottom surface) of the housing, a cartridge receiving portion 148 connected to the guide structure 181, and an electronics system in the housing. The housing may define an opening O' at the first surface 110 of the housing and an opening O" at the second surface 115 of the housing. The housing of the e-vaping case 101 may be formed by joining a front cover to a rear cover, similar to the housing of the e-vaping case 100.

The electronic vaping device 1001 may be formed by inserting the cartridge 400 into the opening O' of the e-vaping case 101. The cartridge 400 may include a body portion. The body portion may include a window 465 that is transparent and/or translucent. As a result, contents inside the body portion (e.g., a level a pre-vapor formulation inside the cartridge 400) may be viewable through window 465. A button protruding portion 146 may be exposed through an aperture A defined by the front of the housing. More details related to the cartridge 400 are described later with reference to FIG. 2D. The guide structure may be a guide plate 181. The guide plate 181 may be formed of a metal, metal alloy, a plastic, a fibrous material (e.g., wood), a ceramic, or a combination thereof. A puff-sensor may be omitted from the e-vaping case 101 and/or the cartridge 400.

The electronics system 200 in the e-vaping case 101 of the electronic vaping device 2000 may be the same as or similar to the electronics system 200 described with reference to FIGS. 1A to 1G.

The e-vaping case may include a button structure including the button protruding portion 146 and a button wall portion 151. First to fourth bump structures 255, 260, 265, and 270 may be spaced apart from each other in a vertical direction inside of the housing. The first to fourth bump structures 255, 260, 265, and 270 may formed of the same material as the housing or a different material. The housing, for example the intermediate portion 105, may be formed of a metal, metal alloy, a plastic, a fibrous material (e.g., wood), a ceramic, or a combination thereof. The first to fourth bump structures 255, 260, 265, and 270 may be connected to an inner surface of the housing, such as an interior of the housing that faces the button wall portion 151. Alternatively, at least one of the first to fourth bump structures 255, 260, 265, and 270 may be defined by a protruding portion of the inner surface of the housing.

As shown in FIG. 2C, the aperture A may be defined by an intermediate portion 105 of the housing. The aperture A may be between the first surface 110 of the housing and the second surface 115 of the housing. The aperture A may include a first border (e.g., top border) adjacent to the first surface 110 of the housing and a second border (e.g., bottom border) adjacent to the second surface 115 of the housing.

The aperture A may include third and fourth borders (e.g., left and right borders) that connect the first and second borders to each other. The cartridge receiving portion 148 may be configured to be moved between the first and second surfaces 110 and 115 of the housing by adjusting a position of the button protruding portion 146 in the aperture A such that moving the button protruding portion 146 towards the first surface 110 of the housing corresponds to moving the cartridge receiving portion 148 towards the first surface 110 of the housing and moving the button protruding portion 146 towards the second surface 115 of the housing corresponds to moving the cartridge receiving portion 148 towards the second surface 115 of the housing. The first and second borders of the aperture A may limit a distance that the button protruding portion 146 may be adjusted in the aperture A.

The cartridge receiving portion 148 may include an electrical contact structure 245. The electrical contact structure 245 may be formed of a conductive material such as a metal or a metal alloy. The electrical contact structure 245 may be electrically connected to the electronics system 200. The cartridge receiving portion 148 may be configured to reversibly snap in place if the cartridge receiving portion 148 is moved to the first position P1. The electronics system 200 may be configured to initiate the transfer of power to the electrical contact structure 245 using the power supply 230 if the cartridge receiving portion 148 is snapped in place at the first position P1. The cartridge receiving portion 148 may be configured to be un-snapped and moved along the guide structure 181 toward the second surface 115 of the housing after being reversibly snapped in place. The electronics system 200 may be configured to interrupt the transfer of power to the electrical contact structure 245 if the cartridge receiving portion 148 is un-snapped.

The e-vaping case 101 may include a button structure and connecting members 191 in the housing. The button structure may include the button protruding portion 146, pegs 147, and the button wall portion 151. The pegs 147 may extend from a surface of the button protruding portion 146. A front face of the button wall portion 151 may define female connecting members 134. The pegs 147 may be inserted into the female connecting members 134 to form a snap-fit connection that connects the button protruding portion 146 to the button wall portion 151.

The guide structure 181 may be in the housing. The connecting members 191 may pass around sides of the guide structure 181 and connect the cartridge receiving portion 148 to the button structure. A surface of the button wall portion 151 that is opposite the female connecting members 134 may define other female connecting members 133 at a different height the female connecting members 134. A surface of the cartridge receiving portion 148 may define female connecting members 131 adjacent to the electrical contact structure 245. Opposite ends of the connecting members 191 may be inserted into corresponding female connecting members 131 and female connecting members 133, respectively, and may form snap-fit connections to connect the cartridge receiving portion 148 to the button wall portion 151.

When the intermediate portion 105 of the housing encloses the button structure connected to the cartridge receiving portion 148, the button protruding portion 146 may extend into the aperture A and face an outside of the housing. The cartridge receiving portion 148 may be configured to be moved between the first surface 110 and the second surface 115 of the housing by adjusting a position of the button protruding portion 146 in the aperture A. Moving the button protruding portion 146 towards the first surface 110 of the housing may move the cartridge receiving portion 148 towards the first surface 110 of the housing. Moving the button protruding portion 146 towards the second surface 115 of the housing may correspond to moving the cartridge receiving portion 148 towards the second surface 115 of the housing.

The switch sensor 240 may be in the housing. The cartridge receiving portion 148 may include a level member 148L. The level member 148L may be a portion of the cartridge receiving portion 148 that extends from a side of the cartridge receiving portion 148. The level member 148L may be between the switch sensor 240 and the second surface 115 of the housing. A height the level member 148L may be between an upper surface and a lower surface of the cartridge receiving portion. The cartridge receiving portion 148 may include two vertical members 148V that are spaced apart from each other and each have a width that is less than a width of the cartridge receiving portion 148. The two vertical members 148V may define a cartridge accommodating area and the electrical contact structure 245 may be disposed in the cartridge accommodating area. The two vertical members 148V may be spaced apart from each other by a distance that is greater than a width of the cartridge 400 and less than entire width of the cartridge receiving portion 148. In other words, the two vertical members 148V may be spaced apart from each other so the cartridge 400 may be inserted between the two vertical members 148V and placed on the electrical contact structure 245. For example, the cartridge 400 may connect to a surface of the cartridge receiving portion 148 and the electrical contact structure 245 like a phone jack, DC jack, or USB plug, etc.

The level member 148L may be configured to contact the switch sensor 240 if the cartridge receiving portion 148 is moved to the first position P1 in the housing. For example, a bottom of the cartridge receiving portion 148 may define a hooked portion 148H that extends toward the second surface 115 of the housing. As shown in FIG. 2B, the first position P1 of the housing may be between the third and fourth bump structures 265 and 270. The first position P1 may correspond to a location of the cartridge receiving portion 148 when the hooked portion 148H is disposed between the third and fourth bump structures 265 and 270. The switch sensor 240 may be configured to depress momentarily if the cartridge receiving portion 148 is moved past the first position P1 to a second position P2 in the housing. The second position P2 in the housing may be closer to the first surface 110 of the housing than the first position P1 in the housing. For example, the second position P2 may correspond to a location of the cartridge receiving portion 148 when the hooked portion 148H is above the fourth bump structure 270. For example, second position P2 may correspond to a location when a bottom of the hooked portion 148H contacts an upper surface of the fourth bump structure 270.

The first bump structure 255 and the second bump structure 260 may be adjacent to each other. The third bump structure 265 and the fourth bump structure 270 may be adjacent to each other. The second bump structure 260 and the third bump structure 265 may be between the first bump structure 255 and the fourth bump structure 270.

The hooked portion 148H may be configured to bump over the second bump structure 260 and sit at a zero position P0 in the housing between the first and second bump structures 255 and 260 as the cartridge receiving portion is moved from the first surface 110 of the housing towards the second surface 115 of the housing. The hooked portion 148H may be configured to bump over the third bump structure 265 as the cartridge receiving portion 148 is moved towards the first surface 110 of the housing such that the hooked portion 148H moves from the zero position P0 to the first position P1.

The level member 148L may be configured depress the switch sensor 240 if the cartridge receiving portion 148 is moved towards the first surface 110 of the housing such that the hooked portion 148H moves from the first position P1 between the third and fourth bump structures 265 and 270 and bumps over the fourth bump structure 270.

When the housing encloses the button structure, the switch sensor 240, the cartridge receiving portion 148, and the guide structure 181, the button protruding portion 146 may extend into the aperture A and face an outside of the housing. the button protruding portion is configured to move the level member towards the switch sensor if the button protruding portion is moved towards the first surface of the housing and away from the second surface of the housing. By adjusting the position of the button protruding portion 146 in the aperture A, the button protruding portion 146 may be configured to move the level member 148L away from the switch sensor 240 if the button protruding portion is moved towards the second surface 115 of the housing and away from the first surface 110 of the housing.

The level member 148L may be configured to depress the switch sensor 240 if the button protruding portion 146 is moved to a top boundary of the aperture A and is within a threshold distance D1 of the top boundary of the aperture A. The electronics system 200 may be configured to transfer power to the electrical contact structure 245 if the level member 148L depresses the switch sensor 240. The switch sensor 240 may be configured to snap back down to an original position of the switch sensor 240 after the level member 148L depresses the switch sensor 240.

Figure 2D:
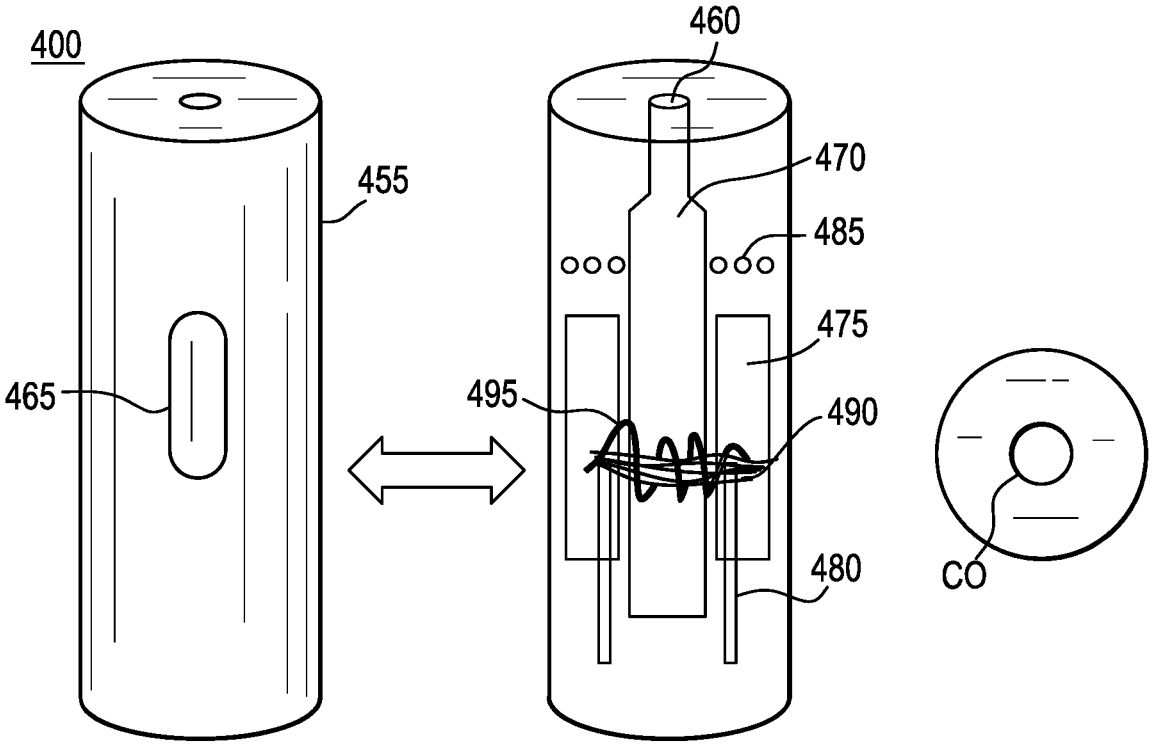
FIG. 2D is a sectional view of a cartridge in the electronic vaping device in FIGS. 2A to 2B.

FIG. 2D is a sectional view of a cartridge in the electronic vaping device in FIGS. 2A to 2B.

In an example embodiment, the cartridge 400 may include a mouth portion 460, a body 455 that defines one or more air holes 485, a reservoir 475 in the body for holding a pre-vaporization formulation, a vaporizer configured to generate a vapor from the pre-vaporization formulation, and electrical leads 480 connected to the vaporizer in the body 455. The cartridge 400 may be configured to protrude at least partially out of the e-vaping case if the cartridge receiving portion 148 is moved is moved towards the first surface 110 of the housing, for example to the first position P1. The air hole(s) 485 defined by the body 455 of the cartridge 400 may be exposed if the cartridge 400 is on the cartridge receiving portion 148 and the cartridge receiving portion 170 is moved to the first position P1. A puff sensor may be omitted from the cartridge 400.

A channel 470 may be defined by an inner housing (e.g., a tube or tubular structure) and may be inside the body 455. The channel 470 may be adjacent to the reservoir 475. A top of the channel 470 may extend through the mouth portion 460. The channel 470 may be in fluid communication with the air hole(s) 485 and extend from the body 455 through the mouth portion 460 to an end of the cartridge 400.

The cartridge 400 may be configured to be recessed into the e-vaping case 101 and to be surrounded by the e-vaping case 101 if the cartridge receiving portion 148 is moved along the guide structure towards the second surface 115 of the e-vaping case 101. Although illustrated in FIGS. 2A and 2B, similar to FIG. 1G, a lid may be configured to cover the opening O' and the cartridge 400 if the cartridge receiving portion 148 is recessed into the housing towards the second surface 115 of the housing. The body 455 and the mouth portion 460 may be each formed of a plastic material, wood, and/or paper, but is not limited to these materials. The body 455 and the mouth portion 460 may be formed of the same material, different materials, or some common materials and some different materials.

The vaporizer may include a wick 490 and a heater 495. The heater 495 may surround the wick 490 in the channel 470. For example, the heater 495 may wrap around the wick 490. Respective ends of the heater 495 may be connected to the electrical leads 480. The wick 490 may extend from the reservoir 475 to the channel 470. For example, the wick 490 may extend from one portion of the reservoir 475 through the channel 470 into another portion of the reservoir 475.

The heater 495 and wick 490 may be the same as or similar to heater 395 and wick 390 described with reference to FIG. 1H. If the heater 495 generates a vapor from a first portion of the pre-vapor formulation, the wick 490 (or a plurality of wicks) may transport a second portion of the pre-vapor formulation proximate to the heater 495 to replenish the first portion of the pre-vapor formulation formed into the vapor. The vapor may be transported to a top of the mouth portion 460 if a negative pressure is applied to the mouth portion 460.

The vaporizer may be configured to generate a vapor from heating a portion of the pre-vapor formulation. Power may be supplied to the heater 495 from the power supply 230 using the electrical contact structure 245 and the electrical leads 480. The power supplied to the heater 495 may generate a vapor from heating the portion of pre-vapor formulation transported to the heater 495 using the wick 490.

Referring to FIG. 2D, the cartridge 400 may include a body 455 and a mouth portion 460. A first surface (e.g., front surface) of the cartridge 400 may include a window 465. The body 455 may have a curved outer periphery (e.g., oval or circular) and the body 455 may be elongated. In the example shown in FIG. 2D, the air holes 485 are defined on a surface of the body that is opposite the surface of the body including the window 465, but example embodiments are not limited thereto.

The cartridge receiving portion 148 may include the electrical contact structure 245 for connecting the electrical leads 480 in the cartridge 400 to the electronics system 200 in the e-vaping case. The electrical leads 480 may be formed of a conductive material such as a metal or a metal alloy.

The cartridge 400 may be configured to be detachably coupled to the cartridge receiving portion 148. For example, a bottom surface of the cartridge 400 may define a cartridge opening CO and the cartridge 400 may be placed on the cartridge receiving portion 148 so the electrical contact structure 245 extends into the cartridge opening CO and connects to the electrical leads 480. Although not illustrated, if the electrical contact structure 245 is alternatively a female electrical connector, then a bottom of the cartridge 400 may include a male electrical connector that may be electrically connected to the electrical leads 480 and may be coupled to the electrical contact structure 245. The electronics system 200 may be configured to generate vapor from the pre-vaporization formulation by transferring power to the vaporizer of the cartridge 400 through the electrical contact structure 245 and electrical leads 480 if the cartridge receiving portion 148 is moved towards the first surface 110 of the housing to at least the first position P1 of the housing.

The electrical leads 480 may be configured to electrically connect the vaporizer to the electrical contact structure 245 of the e-vaping case 101. The e-vaping case may be configured to initiate the generating the vapor by transferring power to the vaporizer of the cartridge 400 using the electrical leads 480. For example, the e-vaping case 101 may be configured to initiate generating the vapor from the pre-vaporization formulation if the cartridge 400 is moved to a first location relative to the e-vaping case. The e-vaping case 101 may be configured to interrupt the generating the vapor if the cartridge 300 is moved toward a second location relative to an end of the e-vaping case. The first location of the cartridge 400 relative to an end of the e-vaping case and the second location of the cartridge 400 relative to an end of the e-vaping case may be different.

The first location of the cartridge 400 relative to the e-vaping case 101 may correspond to a location of the cartridge 400 when the cartridge 400 is coupled to the cartridge receiving portion 148 and the cartridge receiving portion 148 is moved to the first surface 110 such that the level member 148L depresses the switch sensor 240. The second location of the cartridge 400 relative to the e-vaping case 101 may correspond to a location of the cartridge 400 when the cartridge 400 is coupled to the cartridge receiving portion 148 and does not depress the switch sensor 240. For example the second location of the cartridge 400 may correspond to a location of the cartridge 400 the hooked portion 148H is between the fourth bump structure 270 and the first bump structure 255.

Figure 3A:
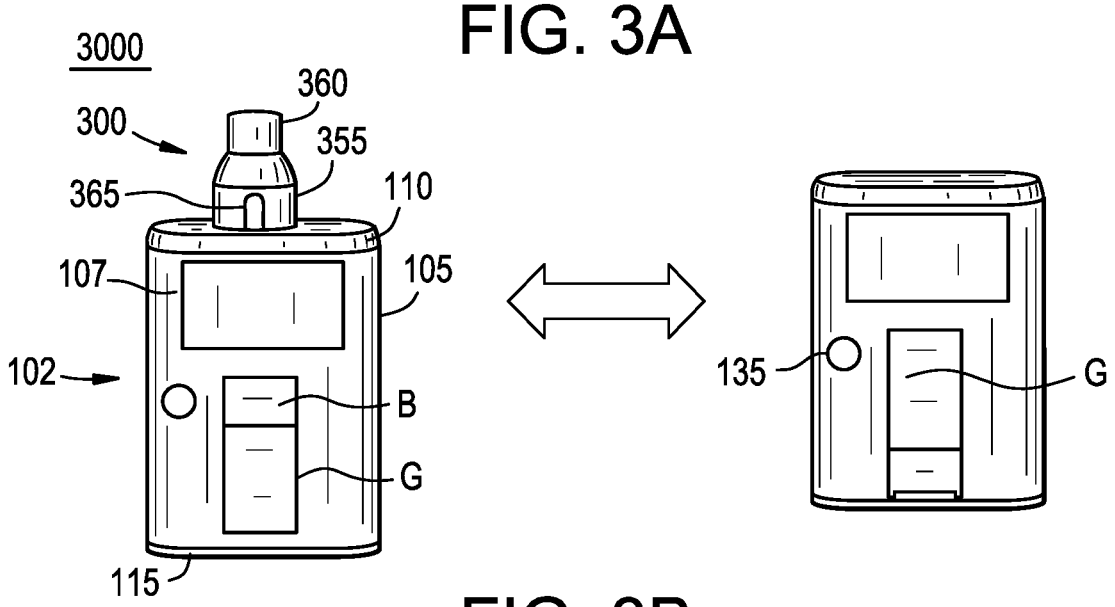
FIGS. 3A to 3C is a perspective view, plan view, and a sectional view of an electronic vaping device according to an example embodiment.
Figure 3B:
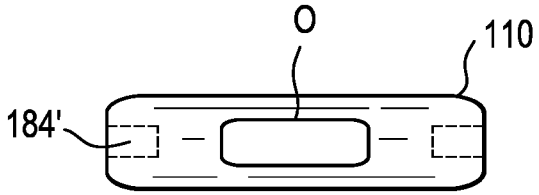
Figure 3C:
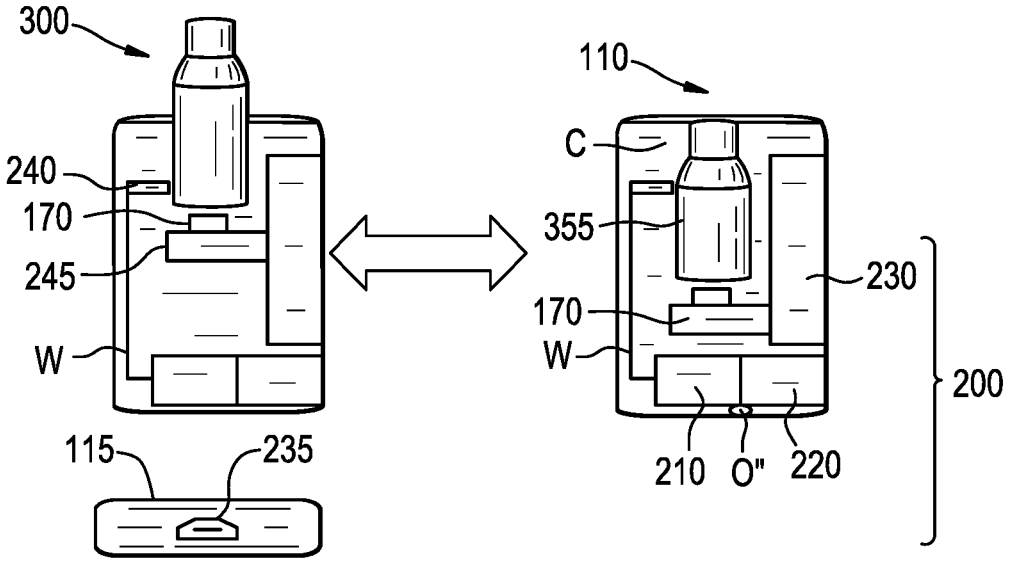
Figure 3D:
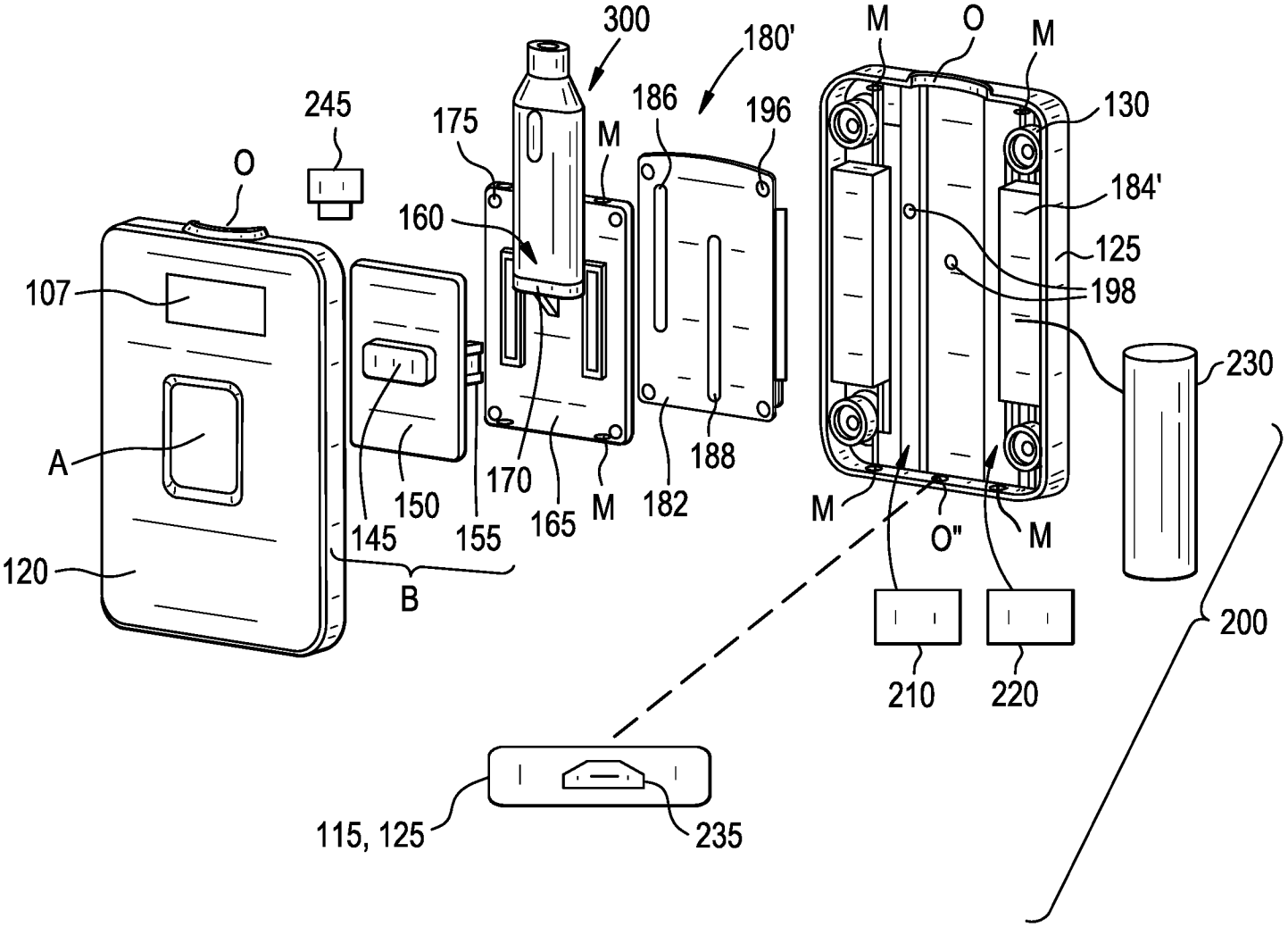
FIG. 3D is an exploded view of the electronic vaping device in FIGS. 3A to 3C.

FIGS. 3A to 3C is a perspective view, plan view, and a sectional view of an electronic vaping device according to an example embodiment. FIG. 3D is an exploded view of the electronic vaping device in FIGS. 3A to 3C.

Referring to FIGS. 3A to 3D, in an example embodiment, an electronic vaping device 3000 may be similar to the electronic vaping devices 1000, 1001, and 1002 described with reference to FIGS. 1A, 1F, and/or 1G. The electronic vaping device 3000 may include an e-vaping case 102 and the cartridge 300.

The e-vaping case 100 may include a housing, a guide structure that extends between the first surface 110 and second surface 115 of the housing, a cartridge receiving portion 170 connected to the guide structure, and an electronics system 200 in the housing. The cartridge receiving portion 170 may be configured to be moved along the guide structure between the first surface 110 and the second surface 115 of the housing. The guide structure may include two guide portions 184' that are spaced apart from each other in the housing. The electronics system may be configured to initiate a transfer of power to the electrical contact structure 245 if the cartridge receiving portion 170 is moved towards the first surface 110 of the housing to at least a first position of the housing. The electronics system 200 may be configured to interrupt the transfer of power to the electrical contact structure 245 if the cartridge receiving portion 170 is moved towards the second surface 115 of the housing.

The housing may include an intermediate portion 105 between the first surface 110 and the second surface 115. The intermediate portion 105 may be formed by connecting the front cover 120 to the rear cover 125 of the housing. The electronics system 200 may be connected to a display screen 107 (e.g., a liquid-crystal display or a light emitting device display) for displaying information about the electronic vaping device 3000, such as the battery charge level, vapor precursor level, puff count, and various operation error messages transmitted to the display screen 107 from the controller 220, but example embodiments are not limited thereto.

The e-vaping case 102 may include a sliding mechanism 180' in the housing. The housing may define a cavity C. The cavity C may be the inner portion of the housing surrounded by the intermediate portion 105 when the front cover 120 and rear cover 125 are connected to each other. The electronics system 200 may be in the cavity. A sidewall of the housing may define the guide structure in the form of the pair of guide portions 184'. The sliding mechanism 180' may include a first plate 182 and tracks 190 attached to respective sides of the first plate 182. The tracks 190 may connect the first plate 182 to the guide portions 184'. The cartridge receiving portion 170 may be connected to the first plate 182. The cartridge receiving portion 170 may be configured to be moved bi-directionally between the first and second surfaces 110 and 115, respectively, of the housing via the tracks 190. For example, the tracks 190 may slide along the guide portions 184'. The carrier structure 160 may be in the housing. The carrier structures 160 may include the carrier plate 165 and the cartridge receiving portion 170. The carrier plate 165 may connect the cartridge receiving portion 170 to the first plate 182 of the sliding mechanism 180'. Magnets M may be attached to the carrier plate 165 at or near the upper and lower surfaces of the carrier plate 165. Magnets M may be attached to inner surfaces of the rear cover 125 near the first and second surfaces 110 and 115 of the housing. One or more stoppers 198 may be attached to an inner surface of the rear cover 125. The stoppers 198 may extend into the first and/or second openings 186 and 188, respectively, of the first plate 182 in order to limit how far the first plate 182 is moved bi-directionally between the first and second surfaces 110 and 115. Together, a part of the housing (e.g., the rear cover 125) where the stoppers 198 are attached and the guide portions 184' may also be referred to as a guide member. The stoppers 198 may include a first stopper and a second stopper that are spaced apart in a staggered manner. The first and second stopper may be configured to limit a distance the first plate 182 moves bi-directionally.

The e-vaping case 102 may include the button structure B. The button structure B may be connected to the carrier plate 165. The cartridge receiving portion 170 may be configured to be moved between the first and second surfaces 110 and 115 of the housing by adjusting a position of the button protruding portion 145 in the aperture A such that moving the button protruding portion 145 towards the first surface 110 of the housing corresponds to moving the cartridge receiving portion 170 towards the first surface 110 of the housing and moving the button protruding portion 145 towards the second surface 115 of the housing corresponds to moving the cartridge receiving portion 170 towards the second surface 115 of the housing.

The electronic vaping device 3000 may be formed by placing the cartridge 300 on the cartridge receiving portion 148. The cartridge 300 may be detachably coupled to the cartridge receiving portion 148 and electrically connected to the electrical contact structure 245. The electrical contact structure 245 may be part of the electronics system 200 in the e-vaping case 102.

Figure 4:
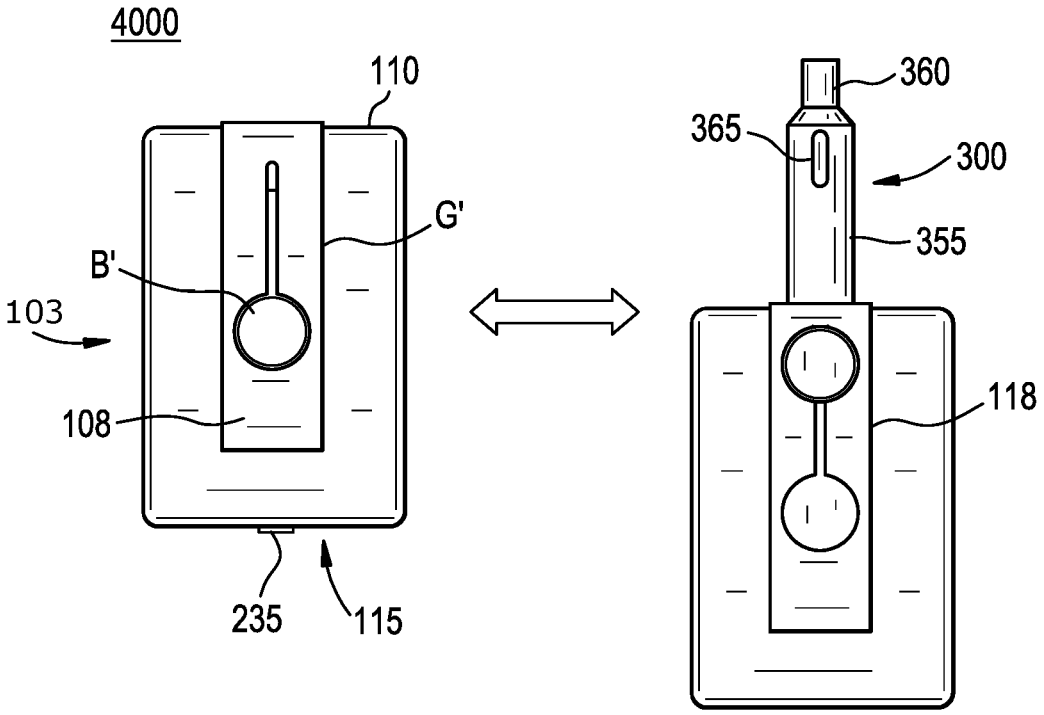
FIG. 4 is a front view of an electronic vaping device according to an example embodiment.

FIG. 4 is a front view of an electronic vaping device according to an example embodiment.

Referring to FIG. 4, in an example embodiment, an electronic vaping device 4000 may be similar to the electronic vaping devices 1000, 1001, 1002, 2000, and 3000 described with reference to FIGS. 1A to 1G, FIGS. 2A to 2D, and 3A to 3D.

The electronic vaping device 4000 may include an e-vaping case 103 and the cartridge 300. The electronic vaping device 4000 may be formed by attaching the cartridge 300 to a cartridge receiving portion in the e-vaping case 103, for example through an opening defined by the first surface 110 of the housing. An electronics system may be in the case and may include the electrical contact structure. The electronics system may be the same as or similar to the electronics system 200 of the e-vaping cases 100, 101, and 102 described above.

The e-vaping case 103 may include a housing, a guide structure that extends between the first surface 110 and the second surface 115 of the housing, a cartridge receiving portion connected to the guide plate 118, and an electronics system in the housing. The cartridge receiving portion may be configured to be moved along the guide plate 118 between the first surface 110 and the second surface 115 of the housing. The guide plate 118 made define a path for moving a button structure B' bi-directionally between the first surface 110 and the second surface 115 of the housing. The electronics system may be configured to initiate a transfer of power to an electrical contact structure if the cartridge receiving portion is moved towards the first surface 110 of the housing to at least a first position of the housing. The electronics system may be configured to interrupt the transfer of power to the electrical contact structure if the cartridge receiving portion is moved towards the second surface 115 of the housing.

The electronics system 200 may be connected to a display screen 108 (e.g., a liquid-crystal display or a light emitting device display) for displaying information about the electronic vaping device 4000, such as the battery charge level, vapor precursor level, puff count, and various operation error messages transmitted to the display screen 108 from the controller in the electronics system, but example embodiments are not limited thereto.

The button structure B' may be connected to the cartridge receiving portion and the housing may enclose the cartridge receiving portion. The button structure B' may include a button protruding portion that may extend through the path defined by the guide plate 118 and face an outside of the e-vaping case 103. Inside of the e-vaping case 103, the button structure B' may be connected to a carrier structure and a sliding mechanism that are the same as or similar to the carrier structure 160 and sliding mechanism 180 described with reference to FIGS. 1B and 1C. In this regard, because the button structure B' may be connected to the carrier structure and the sliding mechanism. The cartridge receiving portion may be configured to be moved between the first and second surfaces 110 and 115 of the housing by adjusting a position of the button protruding portion of the button structure B'. For example, moving the button protruding portion of the button structure B' towards the first surface 110 of the housing may correspond to moving the cartridge receiving portion towards the first surface 110 of the housing and moving the button protruding portion of the button structure B' towards the second surface 115 of the housing corresponds to moving the cartridge receiving portion towards the second surface of the housing.

Alternatively, inside of the e-vaping case 103, the button structure B' may be connected to a carrier structure and a sliding mechanism that are the same as or similar to the carrier structure 160 and sliding mechanism 180' described with reference to FIG. 3D. The sliding mechanism inside the e-vaping case 103 may be attached to a pair of guide portions using tracks, like to the connection arrangement between the sliding mechanism 180' and guide portions 184' in the e-vaping case 102 described with reference to FIGS. 3A to 3D.

The electronic vaping device 3000 is not limited to the cartridge 300. In an alternative embodiment, the shape of the opening defined by the housing of the e-vaping case 103 may be modified to accommodate the cartridge 400 described with reference to FIGS. 2A and 2D. The button structure B' of the e-vaping case 103 may be connected to a cartridge receiving portion and a guide structure using an arrangement that is the same as or similar to the connection of the button structure (e.g., button protruding portion 146, pegs 147, button wall portion 151) to the guide structure 181 and the cartridge receiving portion 148 in FIGS. 2A to 2D. Additionally, like the e-vaping case 101 in FIGS. 2A to 2C, the housing of the e-vaping case 103 may include bump structures like the bump structures 255, 260, 265, and 270 in the e-vaping case 103. Consequently, in the e-vaping case 103 according to the alternative embodiment, as cartridge receiving portion is moved bi-directionally between the first and second surfaces 110 and 115 of the housing, a hooked portion of the cartridge receiving portion may bump over and/or contact the bump structures.

Figure 5A:
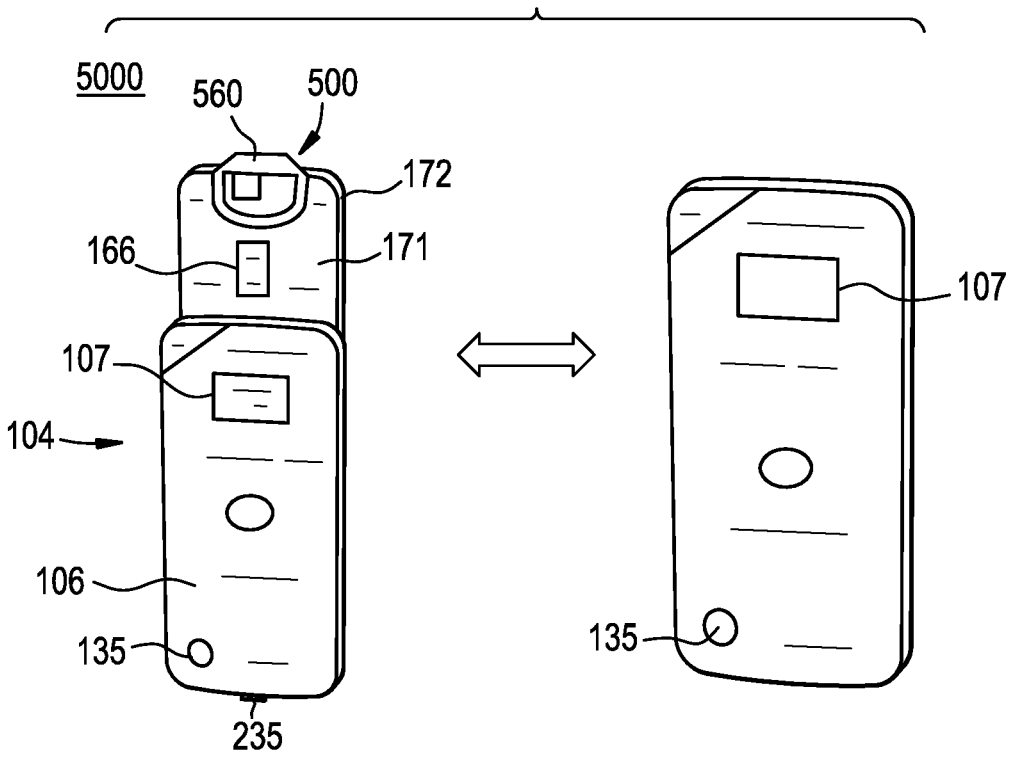
FIGS. 5A to 5C are a perspective view, a plan view, and a sectional view of an electronic vaping device according to an example embodiment.
Figure 5B:
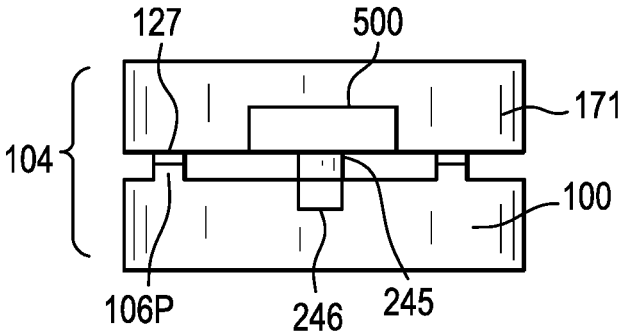
Figure 5C:
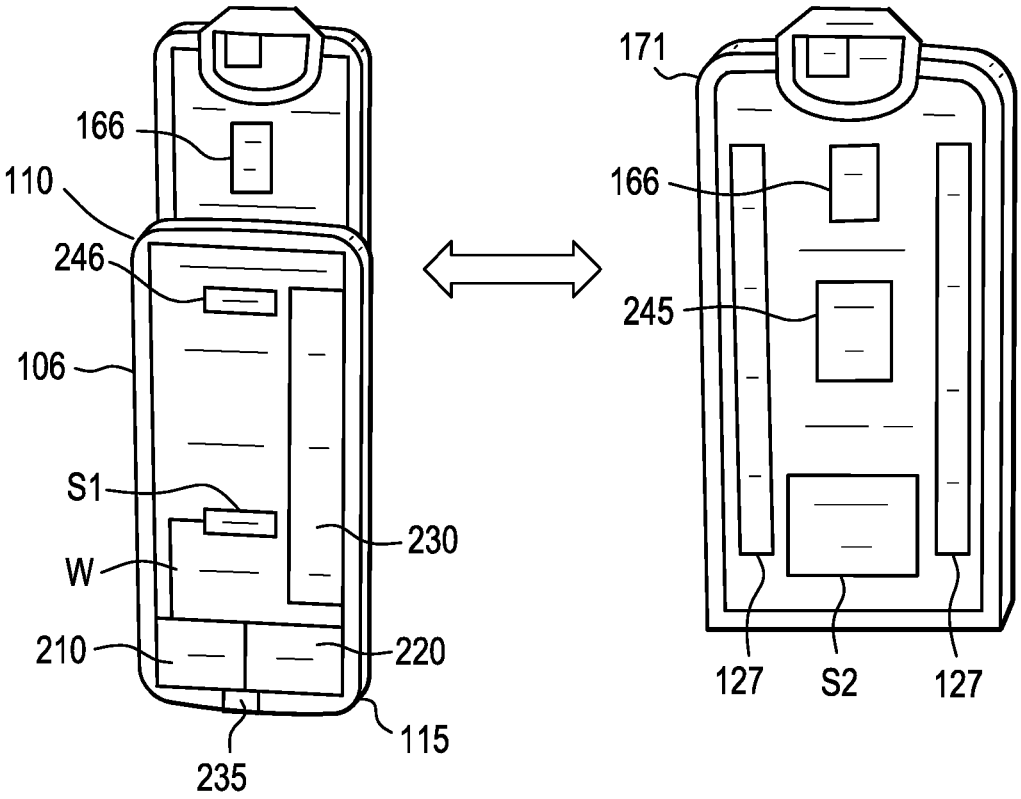

FIGS. 5A to 5C are a perspective view, a plan view, and a sectional view of an electronic vaping device according to an example embodiment.

Referring to FIGS. 5A to 5C, the electronic vaping device 5000 may include an e-vaping case 104 and a cartridge 500. The cartridge 500 may be detachably coupled to the e-vaping case 104. The e-vaping case 104 may include a housing 106, a guide structure 127 that extends between a first surface 110 of the housing and a second surface 115 of the housing, a cartridge receiving portion 171 connected to the guide structure 127, and an electronics system 200. The cartridge receiving portion 171 may be configured to be moved bi-directionally using the guide structure 127. The electronics system 200 may include a power supply 230 that is configured to initiate a transfer of power to an electrical contact structure 245 if the cartridge receiving portion 171 is moved towards the first surface of the housing to at least a first position of the housing. The electronics system 200 may be configured to interrupt the transfer of power to the electrical contact structure 245 if the cartridge receiving portion 171 is moved towards the second surface 115 of the housing. The electronics system 200 may include an external device connection structure 235 for connecting to an external device (e.g., power charger, computer, etc.).

Referring to FIG. 5A, a bottom surface of the cartridge receiving portion 171 may be adjusted to a first position of the housing such that the bottom surface of the cartridge receiving portion 171 is above the second surface 115 of the housing 106. The bottom surface of the cartridge receiving portion 171 may be moved towards the second surface 115 of the housing 106 such that the second surface 115 of the housing may be about level with the bottom surface of the cartridge receiving portion 171.

The cartridge receiving portion 171 may be attached to a back surface of the housing 106 and may be configured to be moved along the guide structure 127 in a vertical direction from behind the housing 106. The guide structure 127 may be rails. Protruding portions 106P of the housing 106 may be used to connect the housing to the guide structure 127. The guide structure 127 may be connected to the cartridge receiving portion 171.

The cartridge receiving portion 171 may include a frame 172. The cartridge receiving portion 171 may include a window 166. The window 166 may be transparent and may allow viewing a level of pre-vapor formulation in a reservoir in the cartridge 500. A button 135 may be attached to an outer surface of the housing. The screen 107 may be attached to the housing 106. The screen 107 may be connected to the electronics system 200. The button 135 may be connected to the electronics system 200. Alternatively, the button 135 may be omitted. A puff sensor may be omitted from the e-vaping case 104.

An air hole of the cartridge may be exposed if the cartridge 500 is coupled to the cartridge receiving portion 171 and the cartridge receiving portion is moved to the first position. The cartridge 500 may include a mouth piece 560. A back surface of the housing 106 may cover the mouth piece 560 if the cartridge 500 is coupled to the cartridge receiving portion 171 and the cartridge receiving portion 171 is moved to a second position along the guide structure. A puff sensor may be omitted from the cartridge 500.

The electronics system 200 may include a driving circuit 210, a controller 220, a power supply 230, an external device connection structure 235, an electrical contact 246, a wire W, and a sensor S1. The cartridge receiving portion 171 may include a sensor S2 and the electrical contact structure 245. Although not illustrated, wires may connect the controller 220 to the power supply and may connect the power supply 230 to the electrical contact 246. If the cartridge receiving portion 171 is moved towards the first surface of the housing 106 to at least a first position of the housing 106, then the sensor S1 of the electronics system 200 may be about the same height as the sensor S2 and may contact the sensor S2. Additionally, the electrical contact 246 may be about the same height as the electrical contact structure 245 and may contact the electrical contact structure 245. Using the sensor S1, the controller 220 may detect the sensors S1 and S2 at about the same height and may direct the power supply 230 to provide power to the cartridge 500 through the electrical contact 246 and the electrical contact structure 245. The electronics system 200 may be configured to interrupt the transfer of power to the electrical contact structure 245 if the cartridge receiving portion 171 is moved towards the second surface 115 of the housing.

The cartridge 500 may include a vaporizer, a channel, and a reservoir. The reservoir may be used to store pre-vapor formulation. The electronics system 200 may be configured to automatically transfer the power to the vaporizer in the cartridge 500 if the cartridge receiving portion is moved to the first position of the housing 106. Alternatively, the electronics system 200 may be configured to automatically transfer the power to the vaporizer in the cartridge 500 if the button 135 connected to the electronics system 200 is pressed when the cartridge receiving portion 171 is at the first position of the housing 106.

Figure 6A:
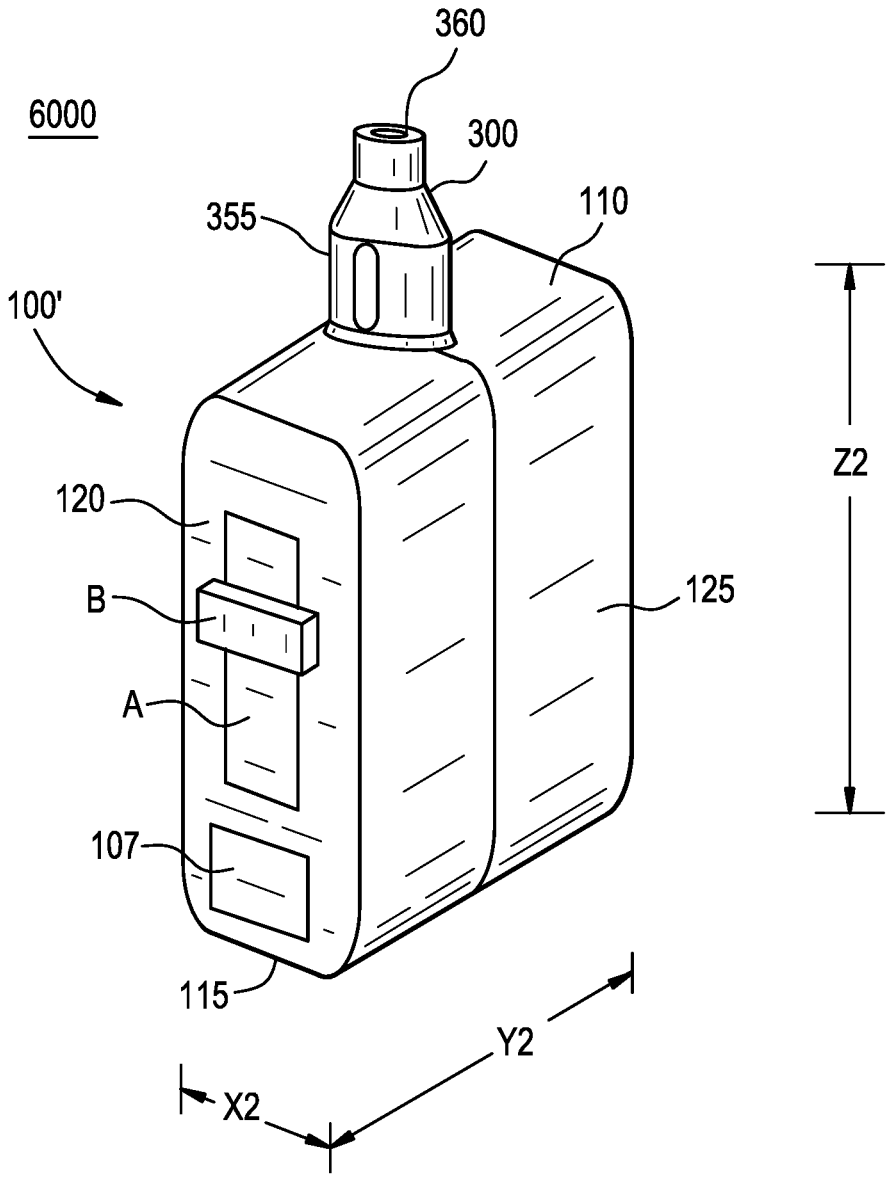
FIG. 6A is a perspective view of an electronic vaping device according to an example embodiment.
Figure 6B:
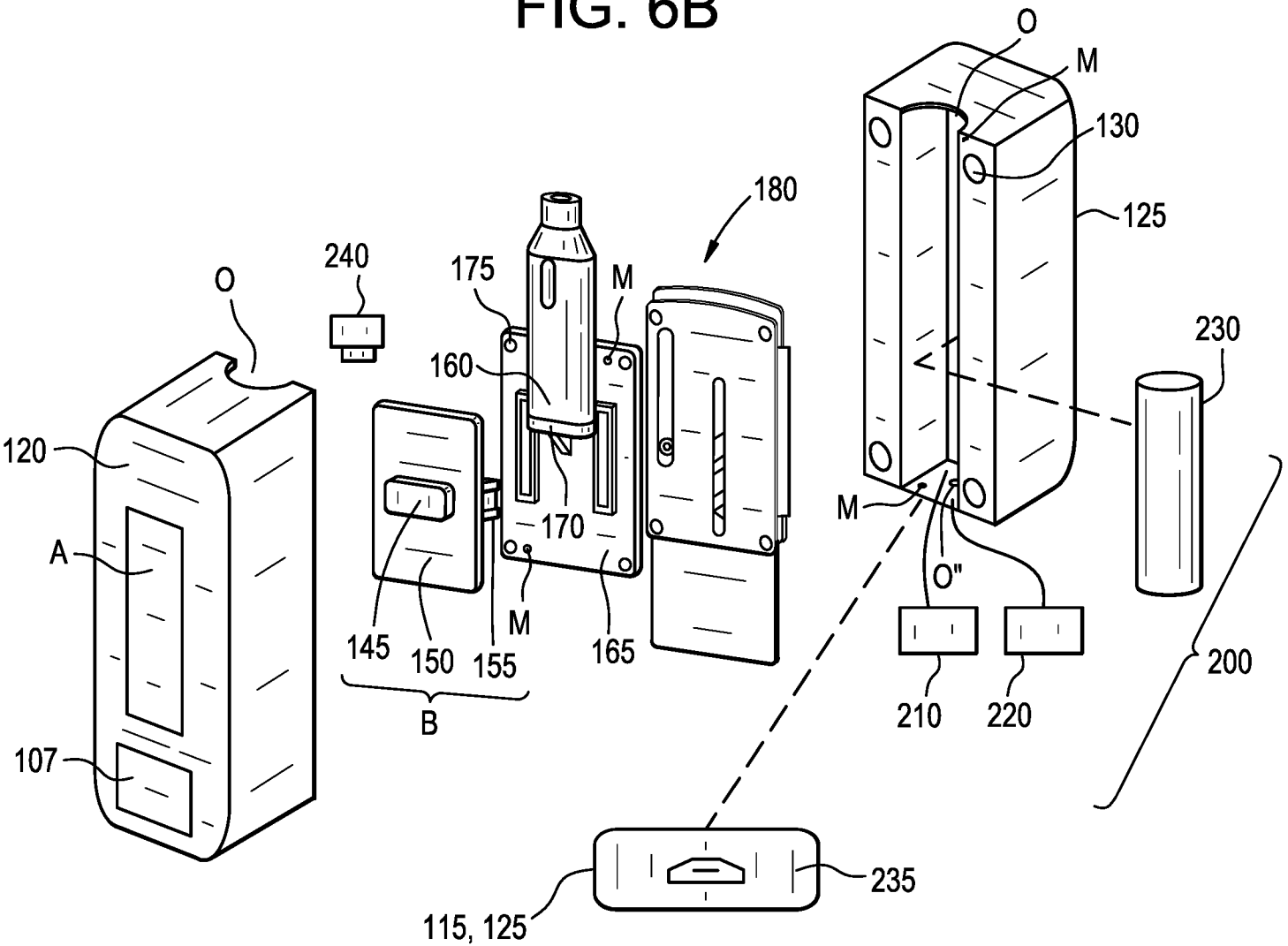
FIG. 6B is an exploded view of the electronic vaping device in FIG. 6A.

FIG. 6A is a perspective view of an electronic vaping device according to an example embodiment. FIG. 6B is an exploded view of the electronic vaping device in FIG. 6A.

Referring to FIGS. 6A and 6B, the electronic vaping device 6000 may be the same as (or substantially the same as) the electronic vaping device 1000 described with respect to FIG. 1A except for the dimensions of the e-vaping case 100'. As shown in FIG. 6A, the e-vaping case 100' may have a width X2 that is less than its thickness Y2. The height Z2 of the e-vaping case 100' may be greater than its thickness Y2. Additionally, the widths of the button structure B, carrier structure 160, and sliding mechanism 180 may be adjusted in order to fit inside the housing (e.g., front cover 120 connected to the rear cover 125). The screen 107 may be attached to the front cover 120 at a location below the aperture A, but is not limited thereto and may alternatively be attached to a side surface of the front cover 120 or rear cover 125. Although not illustrated, the e-vaping case 100' may further include the button 135 and/or lid 140 and hinge H from the e-vaping cases in the e-vaping device 1001 and 1002 described above with reference to FIGS. 1F and 1G.

Similarly, the electronic vaping devices 2000, 3000, 4000, and 5000 described above may be modified so their respective widths are less than their thicknesses.

Figure 7:
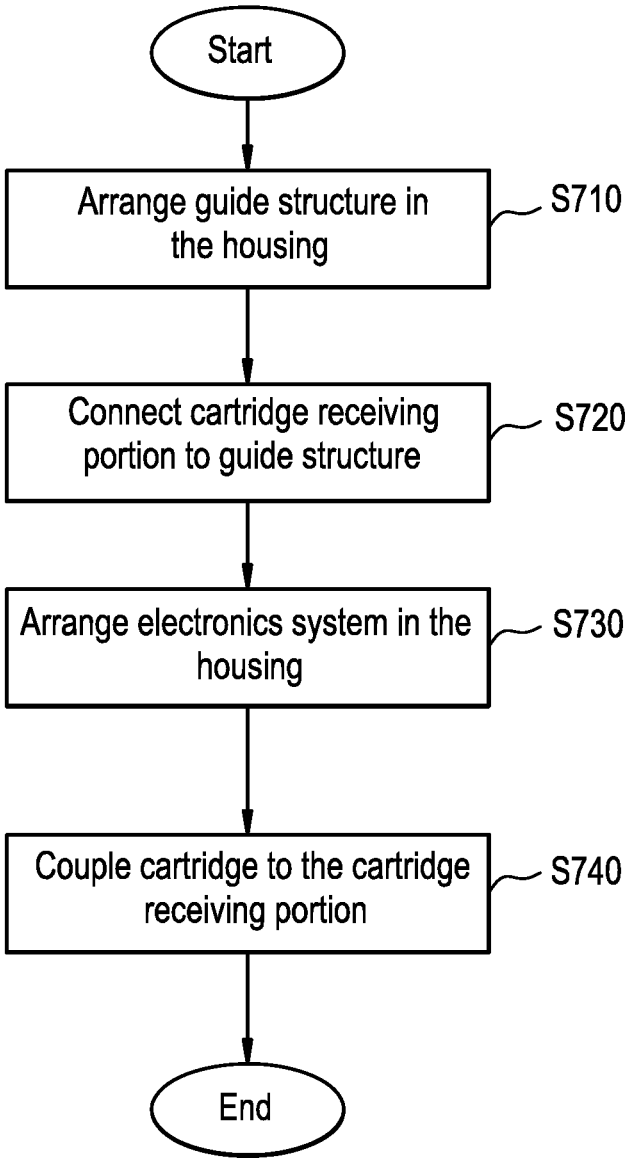
FIG. 7 is a flow chart illustrating a method of making an electronic vaping device according to an example embodiment.

FIG. 7 is a flow chart illustrating a method of making an electronic vaping device according to an example embodiment.

According to an example embodiment, a method of making an electronic vaping device including a case and a cartridge is provided. The method may include forming the case and coupling a cartridge to the case.

Referring to FIG. 7, forming the case may include arranging a guide structure between a first surface of a housing and a second surface of the housing (Operation S710), connecting a cartridge receiving portion to the guide structure (Operation S720, and arranging an electronics system in the housing (Operation S730). The cartridge receiving portion may be configured to be moved along the guide structure between the first surface and the second surface of the housing. The electronics system may include a power supply that is configured to initiate a transfer of power to an electrical contact structure if the cartridge receiving portion is moved towards the first surface of the housing to at least a first position of the housing. The electronics system may be configured to interrupt the transfer of power to the electrical contact structure if the cartridge receiving portion is moved towards the second surface of the housing. Forming the electronic vaping device may further include coupling a cartridge to the cartridge receiving portion of the e-vaping case (Operation S740).

Using the cartridges 300, 400, and 500 described above, a vapor may be generated by heating the pre-vapor formulation in the cartridges. As the pre-vapor formulation is consumed, the cartridges 300, 400, and/or 500 may either be replaced with new cartridges or refilled with additional pre-vapor formulation.

In the electronic vaping devices 1000, 2000, 3000, 4000, 5000, and 6000 described above, a puff sensor may be omitted. Instead of generating vapor in response to the puff sensor detecting the application of a negative pressure to the cartridge, the electronic vaping devices 1000, 2000, 3000, 4000, 5000, and 6000 include electronics systems that are configured to transfer power to corresponding cartridges or terminate the transfer of power to the corresponding cartridges based on at least a position of the cartridge relative to the housing.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

What is claimed is:

1. An e-vaping case comprising:

a housing;

a guide structure that extends between a first surface of the housing and a second surface of the housing;

a cartridge receiving portion connected to the guide structure, the cartridge receiving portion configured to be moved along the guide structure between the first surface and the second surface of the housing;

an electronics system in the housing, the electronics system including a power supply that is configured to initiate a transfer of power to an electrical contact structure if the cartridge receiving portion is moved towards the first surface of the housing to at least a first position of the housing, the electronics system being configured to interrupt the transfer of power to the electrical contact structure if the cartridge receiving portion is moved towards the second surface of the housing;

a switch sensor in the housing; and a button structure connected to the cartridge receiving portion, the button structure being configured to contact the switch sensor if the cartridge receiving portion is moved to the first position in the housing, the switch sensor being configured to depress momentarily if the cartridge receiving portion is moved past the first position to a second position in the housing, the second position in the housing being closer to the first surface of the housing than the first position in the housing, and the switch sensor being configured to snap back to the first position of the housing after being depressed momentarily.

2. The e-vaping case of claim 1, wherein the guide structure is a sliding mechanism in the housing, the housing defines a cavity, the electronics system is in the cavity, the sliding mechanism includes a first plate, tracks, and a second plate in the housing, the tracks connect the first plate to the second plate, the cartridge receiving portion is connected to the first plate, and the cartridge receiving portion is configured to move bi-directionally between the first and second surfaces of the housing via the tracks.

3. The e-vaping case of claim 1, further comprising:

a button attached to the housing, wherein the button is electrically connected to the electronics system, and the electronics system is configured to transfer power to the electrical contact structure using the power supply if the cartridge receiving portion is positioned at the first position of the housing and the button is pressed.

4. The e-vaping case of claim 1, wherein the electronics system is configured to initiate the transfer of power to the electrical contact structure if a position of the button structure is adjusted to depress the switch sensor a plurality of times within a threshold period.

5. The e-vaping case of claim 3, wherein the electronics system is configured to terminate the transfer of power to the electrical contact structure using the power supply if the button is pressed longer than a threshold amount of time.

6. The e-vaping case of claim 1, wherein the e-vaping case does not include a puff sensor.

7. An electronic vaping device comprising:

a housing;

a guide structure that extends between a first surface of the housing and a second surface of the housing;

a cartridge receiving portion connected to the guide structure, the cartridge receiving portion configured to be moved along the guide structure between the first surface and the second surface of the housing;

an electronics system in the housing, the electronics system including an electrical contact structure and a power supply that is configured to initiate a transfer of power to the electrical contact structure if the cartridge receiving portion is moved towards the first surface of the housing to at least a first position of the housing, the electronics system being configured to interrupt the transfer of power to the electrical contact structure if the cartridge receiving portion is moved towards the second surface of the housing;

a cartridge on the cartridge receiving portion, the cartridge being configured to be detachably coupled to the cartridge receiving portion and to be electrically connected to the electrical contact structure;

a switch sensor in the housing; and a button structure connected to the cartridge receiving portion, the button structure being configured to contact the switch sensor if the cartridge receiving portion is moved to the first position in the housing, the switch sensor being configured to depress momentarily if the cartridge receiving portion is moved past the first position to a second position in the housing, the second position in the housing being closer to the first surface of the housing than the first position in the housing, and the switch sensor being configured to snap back to the first position of the housing after being depressed momentarily.

8. The electronic vaping device of claim 7, wherein the guide structure is a sliding mechanism in the housing, the housing defines a cavity, the electronics system is in the cavity, the sliding mechanism includes a first plate, tracks, and a second plate in the housing, the tracks connect the first plate to the second plate, the cartridge receiving portion is connected to the first plate, and the cartridge receiving portion is configured to move bi-directionally between the first and second surfaces of the housing via the tracks.

9. The electronic vaping device of claim 7, further comprising:

a button attached to the housing, wherein the button is electrically connected to the electronics system, and the electronics system is configured to transfer power to the electrical contact structure using the power supply if the cartridge receiving portion is positioned at the first position of the housing and the button is pressed.

10. The electronic vaping device of claim 7, wherein the electronics system is configured to initiate the transfer of power to the electrical contact structure if a position of the button structure is adjusted to depress the switch sensor a plurality of times within a threshold period.

11. The electronic vaping device of claim 9, wherein the electronics system is configured to terminate the transfer of power to the electrical contact structure using the power supply if the button is pressed longer than a threshold amount of time.

12. The electronic vaping device of claim 7, wherein the electronic vaping device does not include a puff sensor.

13. A method of making an e-vaping case, comprising:

arranging a guide structure between a first surface of a housing and a second surface of the housing;

connecting a cartridge receiving portion to the guide structure, the cartridge receiving portion being configured to be moved along the guide structure between the first surface and the second surface of the housing;

arranging an electronics system in the housing, the electronics system including a power supply that is configured to initiate a transfer of power to an electrical contact structure if the cartridge receiving portion is moved towards the first surface of the housing to at least a first position of the housing, the electronics system including a switch sensor in the housing, and the electronics system being configured to interrupt the transfer of power to the electrical contact structure if the cartridge receiving portion is moved towards the second surface of the housing; and connecting a button structure to the cartridge receiving portion, the button structure being configured to contact the switch sensor if the cartridge receiving portion is moved to the first position in the housing, the switch sensor being configured to depress momentarily if the cartridge receiving portion is moved past the first position to a second position in the housing, the second position in the housing being closer to the first surface of the housing than the first position in the housing, and the switch sensor being configured to snap back to the first position of the housing after being depressed momentarily.

14. The method of claim 13, wherein the guide structure is a sliding mechanism in the housing, the housing defines a cavity, the electronics system is in the cavity, the sliding mechanism includes a first plate, tracks, and a second plate in the housing, the tracks connect the first plate to the second plate, the cartridge receiving portion is connected to the first plate, and the cartridge receiving portion is configured to move bi-directionally between the first and second surfaces of the housing via the tracks.

15. The method of claim 13, wherein the e-vaping case does not include a puff sensor.

* * * * *